US007875789B2

(12) United States Patent
Mizuhiki et al.

(10) Patent No.: US 7,875,789 B2
(45) Date of Patent: Jan. 25, 2011

(54) WAVEFORM GENERATING APPARATUS, SOUND EFFECT IMPARTING APPARATUS AND MUSICAL SOUND GENERATING APPARATUS

(75) Inventors: Takashi Mizuhiki, Hamamatsu (JP); Kazuhide Iwamoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/704,427

(22) Filed: Feb. 11, 2010

(65) Prior Publication Data

US 2010/0199832 A1 Aug. 12, 2010

Related U.S. Application Data

(62) Division of application No. 12/175,401, filed on Jul. 17, 2008.

(30) Foreign Application Priority Data

Jul. 18, 2007 (JP) ..... 2007-187692

(51) Int. Cl.
*G10H 1/00* (2006.01)

(52) U.S. Cl. ..... 84/626; 84/667; 84/600

(58) Field of Classification Search ..... 84/600–609, 84/626, 667
See application file for complete search history.

(56) References Cited

U.S. PATENT DOCUMENTS 4,283,745 A * 8/1981 Kuper et al. ..... 360/13
4,783,812 A * 11/1988 Kaneoka ..... 381/61
4,898,059 A * 2/1990 Iizuka ..... 84/601
4,960,030 A * 10/1990 Fujimori ..... 84/609
5,020,410 A * 6/1991 Sasaki ..... 84/602
5,119,710 A * 6/1992 Tsurumi et al. ..... 84/615
5,189,238 A * 2/1993 Hayakawa ..... 84/609
5,198,603 A * 3/1993 Nishikawa et al. ..... 84/601
5,345,035 A * 9/1994 Yamada ..... 84/622
5,389,729 A * 2/1995 Hiramatsu ..... 84/601

(Continued)

FOREIGN PATENT DOCUMENTS

JP 06-161886 6/1994

(Continued)

OTHER PUBLICATIONS

Notification of Reasons for Refusal mailed Jul. 21, 2009, for JP Application No. 2007-187692, with English translation, seven pages.

*Primary Examiner*—David S. Warren
(74) *Attorney, Agent, or Firm*—Morrison & Foerster LLP

(57) ABSTRACT

A synthesizer 10 is configured such that when a PC 30 is connected thereto, the synthesizer 10 accepts selection of a tone used for sound generation from among a tone included in an internal tone generation unit 16 and a tone included in a tone generation module 312 provided by the external PC 30, and causes the PC 30 to enable the function of the tone generation module 312, downloads an edit operation accepting program corresponding to the tone generation module 312 from a UI control program memory 315 of the PC 30, and executes the downloaded edit operation accepting program to thereby realize a function of editing data of the tone included in the tone generation module 312, the data being stored in the PC 30, when the tone included in the tone generation module 312 of the PC 30 is selected.

4 Claims, 25 Drawing Sheets

U.S. PATENT DOCUMENTS

| | | | | |
|---|---|---|---|---|
| 5,569,869 | A * | 10/1996 | Sone | 84/609 |
| 5,668,336 | A * | 9/1997 | Miyano | 84/605 |
| 5,739,454 | A * | 4/1998 | Kunimoto | 84/615 |
| 5,750,913 | A * | 5/1998 | Kamiya | 84/625 |
| 5,821,444 | A * | 10/1998 | Yamaura | 84/609 |
| 5,998,722 | A * | 12/1999 | Kondo | 84/622 |
| 6,069,311 | A * | 5/2000 | Hiramatsu | 84/659 |
| 6,096,963 | A * | 8/2000 | Hirano | 84/659 |
| 6,166,316 | A * | 12/2000 | Takahashi et al. | 84/619 |
| 6,184,454 | B1 * | 2/2001 | Imai et al. | 84/622 |
| 6,236,802 | B1 * | 5/2001 | Yamamoto | 386/52 |
| 6,313,387 | B1 * | 11/2001 | Yamauchi | 84/609 |
| 6,355,871 | B1 * | 3/2002 | Yamauchi | 84/609 |
| 6,570,081 | B1 * | 5/2003 | Suzuki et al. | 84/622 |
| 6,629,067 | B1 * | 9/2003 | Saito et al. | 704/207 |
| 6,639,141 | B2 * | 10/2003 | Kay | 84/609 |
| 6,661,965 | B2 * | 12/2003 | Yamamoto | 386/52 |
| 6,751,439 | B2 * | 6/2004 | Tice et al. | 434/350 |
| 6,911,592 | B1 * | 6/2005 | Futamase et al. | 84/622 |
| 6,919,502 | B1 * | 7/2005 | Yamamoto | 84/622 |
| 7,200,813 | B2 * | 4/2007 | Funaki | 715/716 |
| 7,254,644 | B2 * | 8/2007 | Norimatsu et al. | 709/248 |
| 7,279,628 | B2 * | 10/2007 | Miyamoto et al. | 84/615 |
| 7,305,451 | B2 * | 12/2007 | San Andres et al. | 709/216 |
| 7,332,668 | B2 * | 2/2008 | Hsieh | 84/622 |
| 7,375,274 | B2 * | 5/2008 | Hiratsuka | 84/622 |
| 7,437,431 | B2 * | 10/2008 | San Andres et al. | 709/219 |
| 7,495,165 | B2 * | 2/2009 | Suzuki et al. | 84/622 |
| 7,589,274 | B2 * | 9/2009 | Funaki | 84/645 |
| 2001/0012437 | A1 * | 8/2001 | Yamamoto | 386/55 |
| 2002/0029242 | A1 * | 3/2002 | Seto | 709/203 |
| 2002/0114613 | A1 * | 8/2002 | Thai | 386/52 |
| 2003/0135587 | A1 * | 7/2003 | Fisher et al. | 709/219 |
| 2003/0200859 | A1 * | 10/2003 | Futamase et al. | 84/622 |
| 2003/0205125 | A1 * | 11/2003 | Futamase et al. | 84/622 |
| 2004/0094017 | A1 * | 5/2004 | Suzuki et al. | 84/609 |
| 2004/0098404 | A1 * | 5/2004 | Suzuki et al. | 707/102 |
| 2004/0099125 | A1 * | 5/2004 | Kay | 84/609 |
| 2005/0056141 | A1 * | 3/2005 | Uehara | 84/645 |
| 2005/0066797 | A1 * | 3/2005 | Miyamoto et al. | 84/615 |
| 2006/0054004 | A1 * | 3/2006 | Funaki | 84/600 |
| 2006/0107825 | A1 * | 5/2006 | Hiratsuka | 84/622 |
| 2007/0022868 | A1 * | 2/2007 | Nishibori et al. | 84/626 |
| 2007/0074620 | A1 * | 4/2007 | Kay | 84/619 |
| 2007/0227344 | A1 * | 10/2007 | Ryle et al. | 84/723 |
| 2009/0019992 | A1 * | 1/2009 | Mizuhiki et al. | 84/604 |
| 2009/0019993 | A1 * | 1/2009 | Mizuhiki et al. | 84/604 |
| 2009/0106429 | A1 * | 4/2009 | Siegal et al. | 709/227 |
| 2010/0199832 | A1 * | 8/2010 | Mizuhiki et al. | 84/604 |

FOREIGN PATENT DOCUMENTS

| | | |
|---|---|---|
| JP | 07-006114 | 1/1995 |
| JP | 07-168563 | 7/1995 |
| JP | 10-319952 | 12/1998 |
| JP | 2004-013178 | 1/2004 |
| JP | 2005-073293 | 3/2005 |

* cited by examiner

FIG. 10

| RECEIVED COMMAND | PROCESSING EXECUTED ACCORDING TO COMMAND |
|---|---|
| TE FUNCTION INQUIRY | GIVE REPLY OF INFORMATION ON TONE GENERATOR NAMES, EFFECTOR NAMES, AND RESPECTIVE COMPATIBLE APPARATUS MODELS IN TONE GENERATOR LIST AND EFFECTOR LIST |
| LOGIC CONNECTION REQUEST | CONSTRUCT LOGIC CONNECTION BY PROCESSING IN FIG. 11 |
| NOTIFICATION OF TIMBRE INFORMATION FROM TONE GENERATOR CONTROL PROCESS | REGISTER NOTIFIED INFORMATION INTO TONE GENERATOR LIST |
| NOTIFICATION OF EFFECT INFORMATION FROM EFFECTOR PROCESS | REGISTER NOTIFIED INFORMATION INTO EFFECTOR LIST |
| INQUIRY FOR TIMBRE CATEGORY OR TIMBRE NAME | GIVE REPLY BY PROCESSING IN FIG. 17 |
| INQUIRY FOR EFFECTOR CATEGORY OR EFFECTOR NAME | GIVE REPLY BY PROCESSING CORRESPONDING TO PROCESSING IN FIG. 17 |
| TONE GENERATOR ACTIVATION INSTRUCTION | ACTIVATE TONE GENERATOR CONTROL PROCESS AND TONE GENERATOR PROCESS FOR DESIGNATED TONE GENERATOR |
| EFFECTOR ACTIVATION INSTRUCTION | ACTIVATE EFFECTOR CONTROL PROCESS AND EFFECTOR PROCESS FOR DESIGNATED EFFECTOR |
| UI CONTROL PROGRAM REQUEST | TRANSMIT TO REQUEST SOURCE GUI CONTROL PROGRAM FOR REALIZING FUNCTION OF ACCEPTING SETTING OPERATION RELATING TO DESIGNATED TONE GENERATOR OR EFFECTOR |
| CONNECTION SETTING INSTRUCTION | SET DATA INPUT SOURCE AND/OR OUTPUT DESTINATION OF EACH PROCESS ACCORDING TO INSTRUCTION |
| TE DEMON STOP | SAVE TONE GENERATOR LIST AND EFFECTOR LIST AND PERFORM OTHER REQUIRED END PROCESSING |
| ⋮ | ⋮ |

FIG. 13
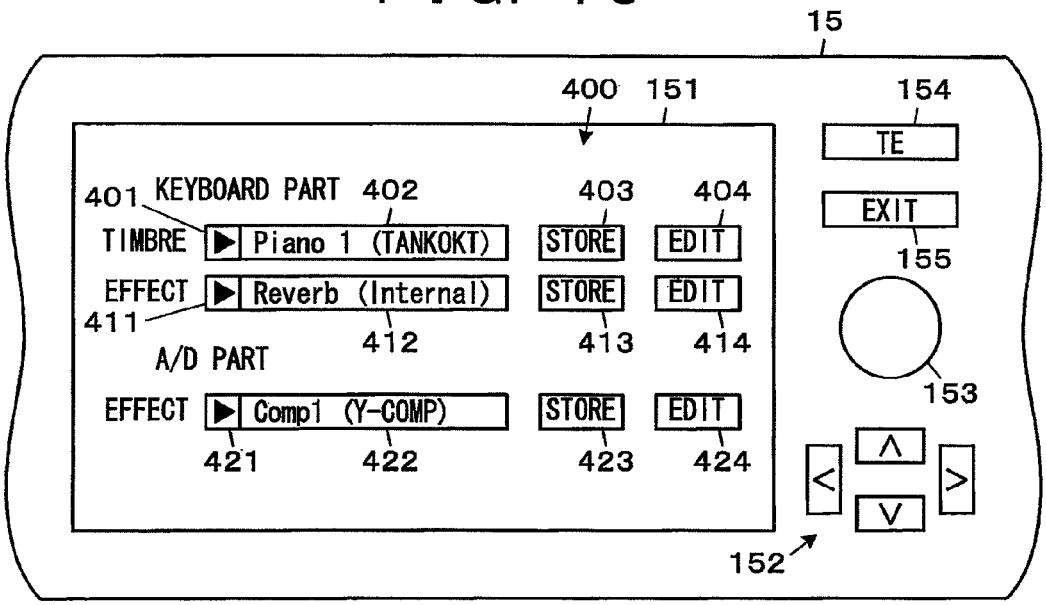
FIG. 14
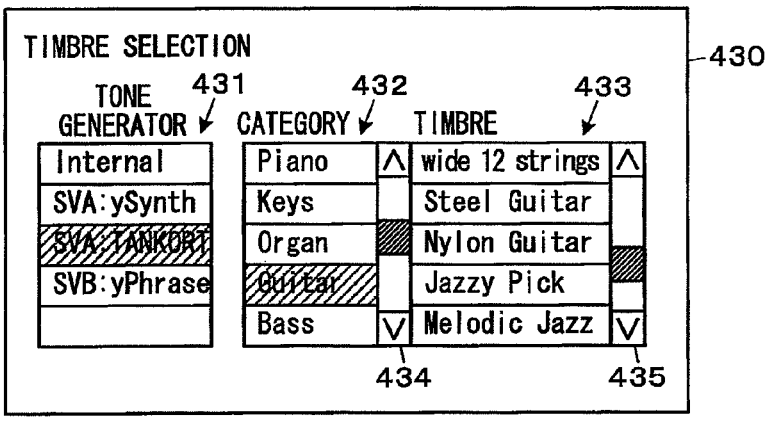
FIG. 15
| | TONE GENERATOR/ TIMBRE | EFFECTOR/ EFFECT | CURSOR POSITION ON SCREEN |
|---|---|---|---|
| TE SERVER WHICH PROVIDES FUNCTION OF SELECTED TONE GENERATOR/EFFECTOR | SVc | SVe | SVd |
| SELECTED TONE GENERATOR/EFFECTOR | TGc | EFe | TGd/EFd |
| SELECTED CATEGORY | CAc | CAe | CAd |
| SELECTED TIMBRE/EFFECT | TCc | FXe | — |

FIG. 23

| RECEIVED DATA | PROCESSING EXECUTED ACCORDING TO DATA |
|---|---|
| PROGRAM CHANGE EVENT(pn) (TIMBRE SETTING INSTRUCTION) | READ pn-TH TIMBRE DATA IN CORRESPONDING TIMBRE LIBRARY AND STORE IT INTO CURRENT TIMBRE DATA MEMORY |
| TIMBRE PARAMETER CHANGE INSTRUCTION | CHANGE VALUE OF PARAMETER IN CURRENT TIMBRE DATA STORED IN CURRENT TIMBRE DATA MEMORY ACCORDING TO CHANGE INSTRUCTION |
| NOTE-ON EVENT(nn, vel) | ASSIGN SOUND GENERATION CHANNEL REQUIRED FOR SOUND GENERATION, SET PARAMETERS IN CHANNEL REGISTER OF ASSIGNED CHANNEL BASED ON TIMBRE DATA STORED IN CURRENT TIMBRE DATA MEMORY, NOTE NUMBER nn, AND VELOCITY vel, AND INSTRUCT START OF SOUND GENERATION |
| OTHER MIDI DATA | SET VALUE OF CHANNEL REGISTER ACCORDING TO CONTENTS OF MIDI DATA |
| TIMBRE DATA TRANSMISSION INSTRUCTION | TRANSMIT TIMBRE DATA STORED IN CURRENT TIMBRE DATA MEMORY TO DESIGNATED DESTINATION |
| STOP INSTRUCTION | NOTIFY TE DEMON OF CATEGORY NAMES AND TIMBRE NAMES IN ALL CATEGORIES, AND CANCEL LOGIC CONNECTION TO MIDI_I/O |
| ⋮ | ⋮ |

FIG. 32

| DETECTED OPERATION | PROCESSING EXECUTED ACCORDING TO OPERATION |
|---|---|
| TOUCH TO SCREEN | DETECT PART CORRESPONDING TO TOUCH POSITION, FROM TOUCH POSITION AND SCREEN DATA |
| TOUCH TO KNOB (IN SCREEN) | MOVE CURSOR TO POSITION OF TOUCHED KNOB |
| TOUCH TO BUTTON (IN SCREEN) | INVERT VALUE OF PARAMETER CORRESPONDING TO BUTTON AND UPDATE DISPLAY OF SCREEN |
| TOUCH TO TAB (IN SCREEN) | CHANGE DISPLAY TO SCREEN CORRESPONDING TO TOUCHED TAB |
| CURSOR KEY OPERATION | MOVE CURSOR TO ANOTHER KNOB IN OPERATED DIRECTION |
| ROTARY ENCODER OPERATION | INCREASE/DECREASE VALUE OF PARAMETER CORRESPONDING TO KNOB AT CURSOR POSITION ACCORDING TO OPERATION |
| ⋮ | ⋮ |

FIG. 33

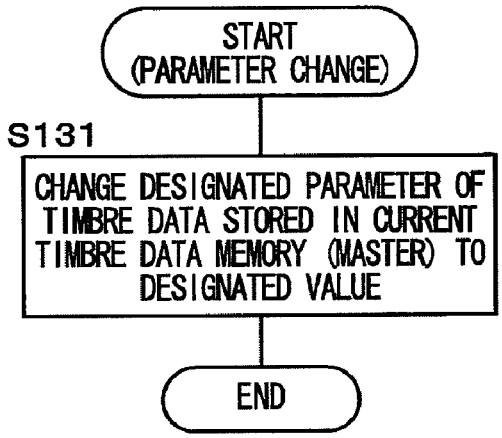

WAVEFORM GENERATING APPARATUS, SOUND EFFECT IMPARTING APPARATUS AND MUSICAL SOUND GENERATING APPARATUS

CROSS-REFERENCE TO RELATED APPLICATIONS

This application is a division of U.S. patent application Ser. No. 12/175,401 filed Jul. 17, 2008, the entire disclosure of which is incorporated herein by reference.

BACKGROUND OF THE INVENTION

1. Field of the Invention

The present invention relates to a waveform generating apparatus and a musical sound generating apparatus having a tone generator which generates waveform data based on setting made in a sound generation channel. The invention further relates to a sound effect imparting apparatus and a musical sound generating apparatus having an effect imparting device which imparts a sound effect to inputted waveform data and outputs the resulting data. More specifically, the invention relates to an apparatus capable of communicating with an external information processing apparatus capable of providing a tone generation function or an effect imparting function.

2. Description of the Related Art

Conventionally, various kinds of apparatuses such as synthesizer, electronic musical instrument and so on have been known as an apparatus having a tone generator or an apparatus having an effect imparting device. Further, it has also been performed to cause a computer such as a PC (personal computer) or the like to execute a required program such as a DAW (digital audio work station) application or the like to thereby realize the functions of the tone generator or effect imparting device via software.

When the hardware incorporated in the main body is insufficient in ability in these apparatuses, the apparatuses are configured such that functions can be added by attaching a tone generator board or an effector board as plug-in boards, or plugging, into the DAW application, a software tone generator to cause a CPU of the PC to execute waveform generation processing or a software effect program to cause the CPU to execute effect application processing.

Such techniques include, for example, that described in the following Document 1.

Document 1: Japanese publication of unexamined patent applications No. 2004-13178 (particularly, Sections 0008 to 0020 and FIG. 6 to FIG. 8)

SUMMARY OF THE INVENTION

However, the above-described conventional function expanding method could not present sufficient convenience.

For example, to make it possible to attach the plug-in board having a tone generator circuit mounted thereon, it is necessary to provide dedicated socket, communication circuit, power supply and so on, which leads to cost increase and constraint on design.

Further, the tone generator and effector expanded by the plug-in boards are handled as units different from the tone generator and effector mounted in the main body, and therefore it is necessary to make setting parameters for them separately from those of the tone generator and effector mounted in the main body in order to appropriately operate the expanded tone generator and effector.

The setting of parameters can be performed from an operation panel on the main body side by acquiring the items and values of the parameters from the plug-in boards, but it is impossible to prepare in advance an user interface (UI) suitable for the parameter configurations in the plug-in boards to be attached, thus forcing the user to use a UI having only basic functions and accordingly poor operability.

Further, it is also known that a PC is connected to an apparatus such as a synthesizer, electronic musical instrument or the like so that a software tone generator or a software effector plugged into the DAW application executed on the PC function as added tone generator or effector. Even in this case, however, when it is tried from the synthesizer, electronic musical instrument or the like to set parameters of functions provided by the DAW application, the user is forced to use a UI having poor operability as in the case of the above-described plug-in board.

Objects of the invention are to solve such problems to make it possible to easily expand a tone generation function and a sound effect application function in a waveform generating apparatus, a musical sound generating apparatus, and a sound effect imparting apparatus, including a synthesizer and an electronic musical instrument, and to easily make setting relating to the expanded functions.

To attain the above objects, a waveform generating apparatus of the invention includes: a first tone generator that generates waveform data; a first memory that stores a timbre data defining a tone color of the waveform data to be generated by the first tone generator; a first library that stores a plurality of timbre data for the first tone generator; a communication device connected to a network for communicating with a computer, connected to the network, having a second tone generator that generates waveform data, a second memory that stores a timbre data defining a tone color of the waveform to be generated by the second tone generator, and a second library that stores a plurality of timbre data for the second tone generator; and a selector, in response to a selection operation by a user, that, when the computer is not connected to the network, selects a timbre data among the plurality of timbre data stored in the first library and, when the computer is connected to the network, selects a timbre data among the plurality of timbre data stored in the first library and the plurality of timbre data stored in the second library, wherein, when a timbre data stored in the first library is selected, the selector reads out the selected timbre data from the first library and stores the timbre data into the first memory and, when a timbre data stored in the second library is selected, the selector instructs the computer via the communication device to read out the selected timbre data from the second library and store the timbre data into the second memory; a controller, in response to performance data supplied in real time, that, when the timbre data stored in the first library is selected by the selector, controls the first tone generator to generate the waveform data according to the timbre data stored in the first memory and the performance data, and, when the timbre data stored in the second library is selected by the selector, instructs the computer controls the second tone generator to generate the waveform data according to the timbre data stored in the second memory and the performance data; and a waveform outputting device that mixes the waveform data generated by the first tone generator and the waveform data generated by the second tone generator and transmitted by the computer for receipt by the communication device, and outputs the mixed waveform data.

Preferably, in the above waveform generating apparatus, the second tone generator is a process executed by the computer and when the computer is initially connected to the network, the waveform generating apparatus instructs the computer to activate the process of the second tone generator via the communication device.

Preferably, the above waveform generating apparatus further includes: a downloader that, when the computer is initially connected to the network, downloads an edit program for the second tone generator from the computer via the communication device; and an editor, in response to an edit operation by the user, that, when the timbre data stored in the first library is selected by the selector, edits the timbre data stored in the first memory and, when a timbre data stored in the second library is selected by the selector, instructs the computer to edit the timbre data stored in the second memory according to the downloaded edit program.

A sound effect imparting apparatus of the invention includes: a first effector that imparts a sound effect to waveform data, inputted to the sound effect imparting device, and outputs the effect imparted waveform data; a first memory that stores an effect data defining a characteristic of the sound effect to be imparted by the first effector; a first library that stores a plurality of effect data for the first effector; a communication device connected to a network for communicating with a computer, connected to the network, having a second effector that imparts a sound effect to waveform data, supplied by the effect imparting device via the communication device, and outputs the effect imparted waveform data, a second memory that stores an effect data defining a characteristic of the sound effect to be imparted by the second effector, and a second library that stores a plurality of effect data for the second effector; and a selector, in response to a selection operation by a user, that, when the computer is not connected to the network, selects an effect data among the plurality of effect data stored in the first library and, when the computer is connected to the network, selects an effect data among the plurality of effect data stored in the first library and the plurality of effect data stored in the second library, wherein, when an effect data stored in the first library is selected, the selector reads out the selected effect data from the first library and stores the effect data into the first memory and, when an effect data stored in the second library is selected, the selector instructs the computer via the communication device to read out the selected effect data from the second library and store the effect data into the second memory; a controller that, when the effect data stored in the first library is selected by the selector, controls the first effector to impart the sound effect to the waveform data according to the effect data stored in the first memory, and, when the effect data stored in the second library is selected by the selector, supplies the inputted waveform data to the computer via the communication device and instructs the computer to control the second effector to impart the sound effect to the waveform data according to the effect data stored in the second memory and to return the effect imparted waveform data to the sound effect imparting apparatus via the network; and a waveform outputting device that mixes the waveform data outputted by the first effector and the waveform data outputted by the second effector and transmitted by the computer for receipt by the communication device, and outputs the mixed waveform data.

Preferably, in the above sound effect imparting apparatus, the second effector is a process executed by the computer and when the computer is initially connected to the network, the sound effect imparting apparatus instructs the computer to activate the process of the second effector via the communication device.

Preferably, the above sound effect imparting apparatus further includes: a downloader that, when the computer is initially connected to the network, downloads an edit program for the second effector from the computer via the communication device; and an editor, in response to an edit operation by the user, that, when the effect data stored in the first library is selected by the selector, edits the effect data stored in the first memory and, when a effect data stored in the second library is selected by the selector, instructs the computer to edit the effect data stored in the second memory according to the downloaded edit program.

A musical sound generating apparatus of the invention has an internal tone generator and a communication device connected to a network for communicating with a computer, connected to the network, capable of providing an expanded tone generation function, the musical sound generating apparatus including: a first device that accepts selection of a timbre used for sound generation from among a timbre included in the internal tone generator and a timbre included in the expanded tone generation function, when the computer is connected to the network; a second device that causes the computer to activate the expanded tone generation function, and downloads an edit operation accepting program corresponding to the expanded tone generation function from the computer, when the timbre included in the expanded tone generation function is selected by the first device; and a third device that executes the downloaded edit operation accepting program to thereby realize a function of editing data of the timbre included in the expanded tone generation function, the data being stored in the computer.

Another musical sound generating apparatus of the invention has an internal effector and a communication device connected to a network for communicating with a computer, connected to the network, capable of providing an expanded effect function, the musical sound generating apparatus including: a first device that accepts selection of an effect imparted to inputted waveform data from among an effect executed by the internal effector and an effect executed by the expanded effect function, when the computer is connected to the network; a second device that causes the computer to activate the expanded effect function, and downloads an edit operation accepting program corresponding to the expanded effect function from the computer, when the effect executed by the expanded effect function is selected by the first device; and a third device that executes the downloaded edit operation accepting program to thereby realize a function of editing data indicating the characteristic of the effect executed by the expanded effect function, the data being stored in the computer.

The above and other object, features and advantages of the invention will be apparent from the following detailed description which is to be read in conjunction with the accompanying drawings.

BRIEF DESCRIPTION OF THE DRAWINGS

FIG. 10 is a view showing an, example of processing executed in response to a received command in Step S205 in FIG. 8;

FIG. 13 is a view showing a portion of the operation panel included in the synthesizer and a display example of a TE setting screen displayed on the operation panel;

FIG. 14 is a view showing a display example of a timbre selection screen;

FIG. 15 is a view showing a list of variables for use in the description of a flowchart;

FIG. 23 is a view showing examples of processing according to the received data executed in Step S234 in FIG. 22;

FIG. 32 is a view showing the correspondence between the contents of the parameter edit operation accepted from the user and the processing executed by the CPU of the synthesizer in response to the operation;

FIG. 33 is a flowchart of local parameter change processing by the synthesizer;

DETAILED DESCRIPTION OF THE PREFERRED EMBODIMENTS

Hereinafter, the best mode for carrying out the invention will be concretely described based on the drawings.

Figure 1:
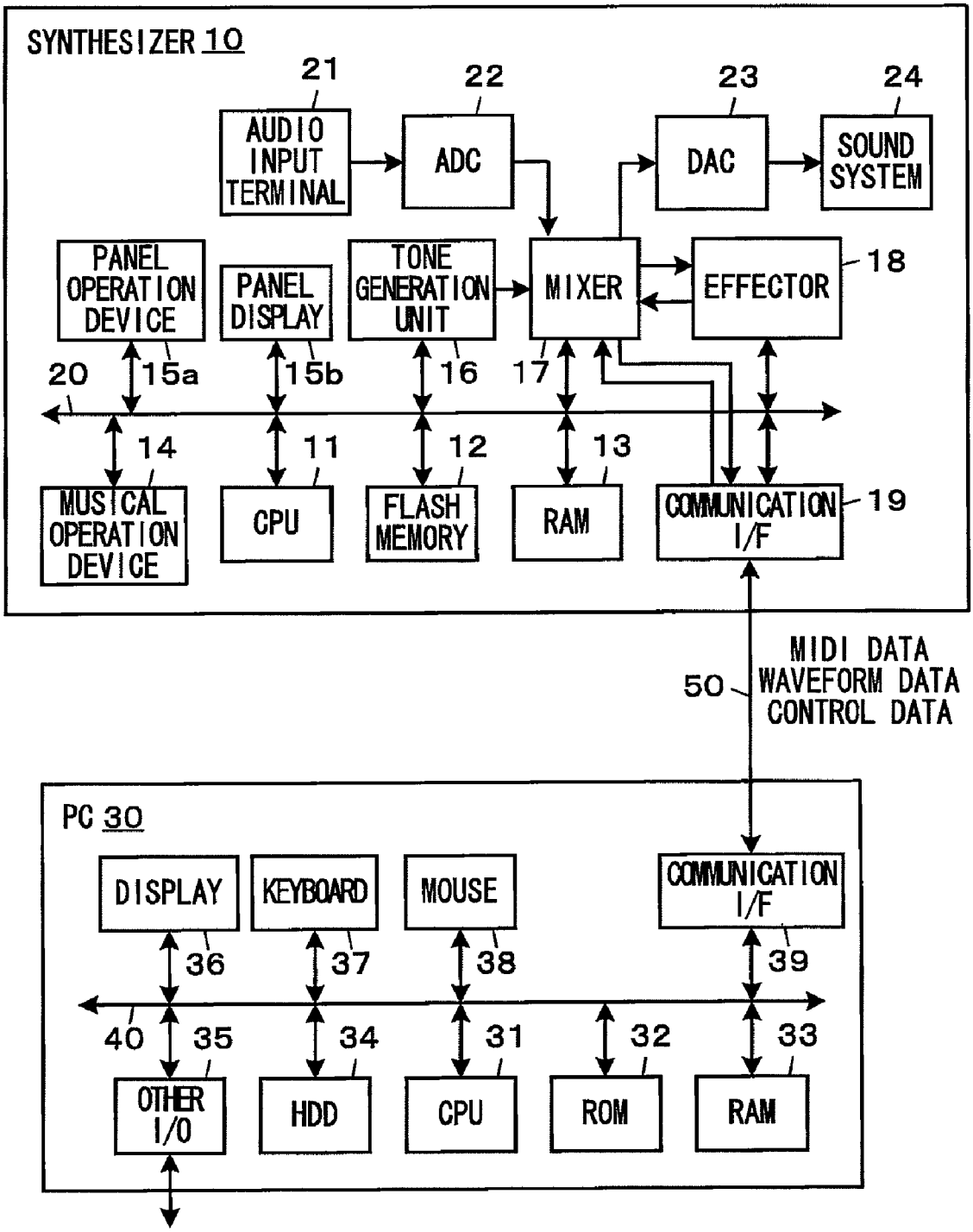
FIG. 1 is a diagram showing hardware configurations of a synthesizer that is an embodiment of a waveform generating apparatus and an embodiment of a musical sound generating apparatus of the invention, and a PC capable of providing a tone generation function to the synthesizer.

First, the hardware configurations of a synthesizer that is an embodiment of a waveform generating apparatus of the invention and is also an embodiment of a musical sound generating apparatus, and a PC capable of providing a tone generation function to the synthesizer are shown in FIG. 1.

As shown in FIG. 1, a synthesizer 10 includes a CPU 11, a flash memory 12, a RAM 13, a musical operation device 14, a panel operation device 15*a*, a panel display 15*b*, a tone generation unit 16, a mixer 17, an effector 18, and a communication I/F 19, all of which are connected to one another via a bus line 20. In addition to them, the synthesizer 10 further includes an audio input terminal 21, an ADC (analog/digital converter) 22, a DAC (digital/analog converter) 23, and a sound system 24.

The CPU 11 is a controller comprehensively controlling the synthesizer 10, and executes a required control program stored in the flash memory 12 to carry out various control operations such as detection of operation contents of the musical operation device 14 and the panel operation device 15*a*, display control of the panel display 15*b*, control of transmission/reception of MIDI data, waveform data, control data and so on via the communication I/F 19, control of generation of the waveform data by the tone generation unit 16, control of mixing by the mixer 17 and so on.

The flash memory 12 is a memory storing control programs executed by the CPU 11, data not to be changed and so on.

The RAM 13 is a memory which is used for a work memory of the CPU 11 and stores values of parameters to be temporarily used and so on.

The musical operation device 14 is controls for accepting musical operation by a user, such as a keyboard, pedals and so on.

The panel operation device 15*a* includes controls, such as key, button, dial, slider, pitch-bend and the like for accepting operations of setting relating to the operation of the synthesizer 10 from the user.

The panel display 15*b* is a display device composed of a liquid crystal display (LCD), a light emitting diode (LED) lamp, or the like, for displaying the operation state and the setting contents of the synthesizer 10 or a message to the user, or a graphical user interface (GUI) for accepting instructions from the user or the like.

Note that the panel display 15*b* and the panel operation device 15*a* can also be integrally formed by stacking a touch panel on the LCD.

The tone generation unit 16 is a first tone generator which generates digital waveform data (audio waveform data) by a plurality of for example, 128 sound generation channels (ch) based on the settings made in each sound generation channel.

The operation of generating the waveform data by the tone generation unit 16 is controlled by the CPU 11, which serves as a tone generator controller, setting appropriately parameters according to the tone color, pitch, strength, envelope and so on of sound to be generated, in a channel register corresponding to the sound generation channel generating the sound, and directing start and stop of sound generation, dump, and so on.

The mixer 17 has functions as a channel mixer, an output mixer, and a setting device for a signal input/output path.

Among them, as the channel mixer, the mixer 17 has a function of generating stereo waveform data for each sampling period made by weighting and accumulating the waveform data generated in each sound generation channel of the tone generation unit 16 for each of L and R systems of stereo to thereby mix those waveform data.

Further, as the output mixer, the mixer 17 has a function of generating waveform data for output by mixing necessary data from among waveform data generated by the tone generation unit 16 and mixed by the channel mixer, waveform data after processing by the effector 18, waveform data received from an external apparatus such as the PC 30 or the like via the communication I/F 19, and the like.

The mixer 17, as the setting device for a signal input/output path, has a function of determining to send the waveform data processed in which module to which module next, according to the setting of the tone generator and the effector used by the synthesizer 10. For example, the mixer 17 outputs the waveform data generated by the tone generation unit 16 and mixed in the channel mixer, waveform data inputted from the ADC 22 or the like, to an appropriate output destination selected from among the effector 18 and an external effector, according to the setting of the effector to be used.

The effector 18 is an effect imparting apparatus which imparts sound effects such as echo, reverb, chorus and so on according to the effect data set by the CPU 11 to the waveform data inputted thereinto and outputs the resulting data. Further, the effector 18 includes one imparting sound effect by changing the waveform characteristic such as compressor, equalizer, noise gate, or de-esser and one imparting sound effect by changing the output timing such as a delay.

The effector 18 may include a signal processing program in the effect data to perform completely different sound effect application processing depending on set effect data.

The communication I/F 19 is an interface for communicating with the external apparatus such as the PC 30 and so on via an appropriate communication path (network) 50. The communication path 50 may be wired or wireless and may or may not have an interconnection device, but employs a communication path capable of real-time transmission (the transmission delay time is not more than several milliseconds) for the MIDI (Musical Instruments Digital Interface) data transmission and transmission/reception of digital waveform data as seen from the synthesizer 10 side, and also capable of transmission of control data such as command, timbre data and so on. For example, it is conceivable to employ an mLAN utilizing IEEE 1394. The USB (Universal Serial Bus) is also employable. As a matter of course, it is not limited to one-to-one communication path.

The sound input terminal 21 is a signal input device for receiving analogue audio signals inputted from an external apparatus such as a microphone, player or the like.

The ADC 22 has a function of converting the analogue audio signals inputted from the sound input terminal 21 into digital waveform data and supplying it to the mixer 17.

The DAC 23 has a function of converting the digital waveform data outputted from the mixer 17 into analogue audio signals and supplying them to the sound system 24.

The sound system 24 is a sound outputting device which is composed of speaker and so on and outputs sound according to the audio signal supplied from the DAC 23.

The above-described synthesizer 10 can generate musical sound in a timbre designated by the user according to the musical operation by the user, and impart sound effects designated by the user to the musical sound and output the resulting sound. The synthesizer 10 can similarly output musical sound generated even by automatic performance.

On the other hand, the PC 30 includes a CPU 31, a ROM 32, a RAM 33, an HDD 34, other I/O 35, a display 36, a keyboard 37, a pointing device such as a mouse 38, and a communication I/F 39, all of which are connected to one another via a bus line 40 via a not-shown interface when necessary, and a known hardware can be used as necessary.

However, used as the communication I/F 39 is one manufactured under a standard capable of communicating with the synthesizer 10 via the communication path 50 which is employed in the synthesizer 10.

Beside, used as each piece of hardware including the CPU 31 is one having an ability of realizing the function of a later-described TE (Tone generator and Effector) server by executing an appropriate program. The program itself may be stored in the ROM 32 and the HDD 34 in advance or downloaded from an external part when necessary.

Note that the PC 30 does not need to be connected to the synthesizer 10 at all times, but can be connected to the synthesizer 10 at any timing when it is desired to expand the tone generation function of the synthesizer 10.

Figure 2:
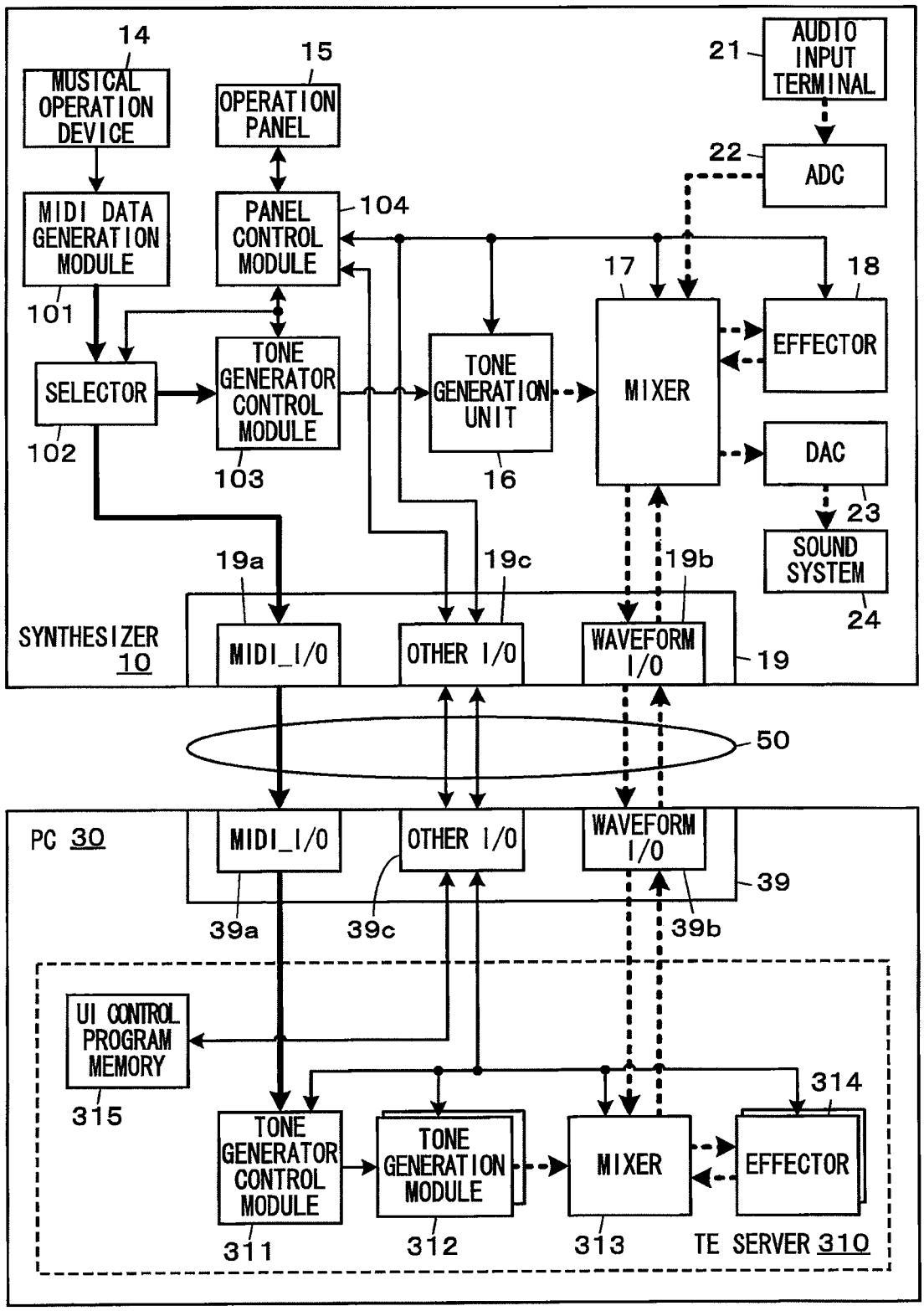
FIG. 2 is a diagram showing functional configurations of the synthesizer and the PC shown in FIG. 1.

Next, functional configurations of the synthesizer 10 and the PC 30 shown in FIG. 1 are shown in FIG. 2.

In this drawing, the transmission path of the MIDI data is shown by a thick solid arrow, and the transmission path of the waveform data is shown by a thick broken arrow.

As shown in FIG. 2, the synthesizer 10 has functions as a MIDI data generation module 101, a selector 102, a tone generator control module 103, and a panel control module 104, in addition to the functions realized by components of the musical operation device 14 to the sound system 24 shown in FIG. 1 (in FIG. 2, the panel operation device 15*a* and the panel display 15*b* are integrally shown as an operation panel 15). These functions of the MIDI data generation module 101 to the panel control module 104 are realized by the CPU 11 executing required programs to control various kinds of hardware included in the synthesizer 10.

Further, the PC 30 has a function of a TE server 310.

Hereinafter, the function of each part will be described.

First, the MIDI data generation module 101 of the synthesizer 10 has a function of detecting the contents of musical operation performed on the musical operation device 14, and according to the operation contents, generating the MIDI data (note-ON, note-OFF, or the like) that is performance data defining the performance contents of a musical composition.

The selector 102 has a function of referring to selection contents of timbre to be used in generating sound, and supplying the MIDI data generated by the MIDI data generation module 101 to the tone generator control module 103 to control the tone generation unit 16 if the timbre to be used is internally provided by the tone generation unit 16, or transmitting the MIDI data generated by the MIDI data generation module 101 to an apparatus (here, the PC 30) which provides the function of the external tone generator to control the external tone generator if the timbre to be used is provided by the external tone generator.

Accordingly, when the timbre of the external tone generator has been selected, the MIDI data generated by the MIDI data generation module 101 is not supplied to the tone generator control module 103, so that the generation of sound (generation of waveform data) by the internal tone generation unit 16 will not be performed.

When transmitted to the PC 30, the MIDI data is transmitted from a MIDI_I/O 19*a* included in the communication I/F 19 and received by a MIDI_I/O 39*a* included in the communication I/F 39 on the PC 30 side.

Though the communication I/Fs 19 and 39 are shown respectively including three I/Os of the MIDI_I/Os 19*a* and 39*a*, waveform I/Os 19*b* and 39*b*, and other I/Os 19*c* and 39*c* in FIG. 2, these I/Os do not need to be independent from each other, but a band for data transmission via the communication path 50 may be appropriately divided for applications of the three kinds of data input/output.

Note that the MIDI data handled by the synthesizer 10 include the data generated by the panel control module 104 based on the operation of the operation panel 16 and the data generated by a not-shown main control module based on the musical composition data as well as the data generated by the MIDI data generation module 101, and the selector 102 similarly handles all those MIDI data. This also applies to the case when the MIDI data is received from the external apparatus such as a MIDI sequencer or the like via the MIDI_I/O.

The tone generator control module 103 has a function of controlling the operation of generating the waveform data in the tone generation unit 16 based on the MIDI data supplied from the selector 102.

For example, when receiving the MIDI data indicating a note-ON event, the tone generator control module 103 assigns a sound generation channel of the tone generation unit 16 to the sound generation corresponding to the event, sets parameters necessary for the sound generation based on the pitch and velocity indicated by the note-ON event and the timbre data in the current timbre data memory into the channel register of the assigned channel, and directs start of the sound generation. When receiving the MIDI data indicating a program change event, the tone generator control module 103 reads timbre data according to the event from the timbre library and stores it as current timbre data in the current timbre data memory referred to by the tone generation unit 16 when generating the waveform data.

The tone generation unit 16 reads the waveform data from a readout address determined according to the values of the parameters set in the channel register of each sound generation channel for each sampling period, and performs interpolation and volume envelope application processing to the data to thereby generate waveform data.

The panel control module 104 controls the operation panel 15 to display the GUI (graphical user interface) on the panel display 15*b*, accepts edit operation of parameters to be used in operating the tone generation unit 16, the mixer 17, the effector 18 and so on together with the panel operation device 15*a*, and edits the parameters according to the accepted operation.

When the synthesizer 10 uses external tone generator and effector, the panel control module 104 further has a function of accepting the edit operation and editing the parameters for the current timbre data defining the timbre of the waveform data generated by the tone generator and the current effect data defining the characteristic of the sound effect imparted by the effector.

The parameter edit function relating to the external tone generator and effector, however, is realized by downloading and executing a UI control program from the external apparatus which provides the function of the tone generator or the effector, and therefore in the state where the synthesizer 10 is not connected to the external apparatus or in the state where the program has not been downloaded, the parameter edit function relating to the external tone generator and effector may not be provided.

The functions of the mixer 17 to the sound system 24 are as those described for FIG. 1.

Note that the mixer 17 receives the waveform data inputted from the tone generation unit/module to be used in generating the waveform data from among the tone generation unit 16 and an external tone generation module 312 (via another mixer 313 or the like as necessary), and outputs the waveform data to the effector to be used in imparting the sound effect from among the effector 18 and an external effector 314 (via the other mixer 313 or the like as necessary). The waveform data inputted from the ADC 22 is similarly outputted to the effector to be used in imparting the sound effect. The mixer 17 mixes the processed waveform data inputted from each effector used in imparting sound effect and outputs the resulting waveform data to the DAC 23.

A method of determining the tone generation unit/module and effector to be used will be described later.

On the other hand, the TE server 310 of the PC 30 is activated when necessary and provides the tone generation function and the effector function in response to a request from an external apparatus.

The TE server 310 has a tone generator control module 311, the tone generation module 312, the mixer 313, the effector 314, and a UI control program memory 315.

Among them, the tone generation module 312 is a second tone generator which generates waveform data in a plurality of channels based on the parameter setting made in each sound generation channel. The tone generation module 312 further has a function of a channel mixer generating stereo waveform data for each sampling period by controlling the volume and accumulating the waveform data in the same sampling period for the generated waveform data of the plurality of channels for each of L and R systems of the stereo to thereby mix those pieces of waveform data.

The tone generator control module 311 has a function of controlling the operation of generating the waveform data in the tone generation module 312 based on the supplied MIDI data. The supply source of the MIDI data is the selector 102 in the synthesizer 10 here.

These tone generator control module 311 and tone generation module 312 respectively have the same kind of functions as the tone generator control module 103 and tone generation unit 16 on the synthesizer 10 side in terms of the tone generation function, but the concrete contents such as the functions of generating the number of available sound generation channels, the generation algorithms for the waveform data and so on do not need to match each other. Conversely, the tone generator control module 311 and tone generation module 312 are preferable to be able to provide functions different from those included on the synthesizer 10 side.

Various types of software tone generators to be plugged into a DAW application (software tone generator plug-ins) having various functions are commercially available from many companies, and the functions of the tone generator control module 311 and the tone generation module 312 are preferably realized by similar programs as that of the software tone generator plug-ins. The software tone generator (the tone generator control module 311, the tone generation module 312, and the later-described UI control program) to be plugged into the TE server 310 does not need to be activated at all times, but it is only required for the CPU 31 to start execution of the program of the required software tone generator plug-in to thereby enable the function when the synthesizer 10 instructs the TE server 310 to activate it. A plurality of programs of software tone generators have been here installed in the PC 30, so that the TE server 310 can selectively activate a program designated by the activation instruction to enable a desired tone generation function.

Beside, the effector 314 is a second effect imparting device which imparts sound effect to the inputted waveform data, and the waveform data after application of effect is outputted to the external part via the mixer 313. The effector 314 has the same kind of function as that of the effector 18 on the synthesizer 10 side in terms of the function of imparting sound effect, but the concrete contents of the functions of imparting sound effect such as the kinds of available effects, the processing ability and so on do not need to match each other. Conversely, the effector 314 is preferable to be able to provide a function different from that included on the synthesizer 10 side.

The functions of the effector 314 are also preferably realized by a program similar to that of a software effect to be plugged into a DAW application (software effect plug-in). The software effect (the effector 314 and the later-described UI control program) to be plugged into the TE server 310 does not need to be activated at all times, but it is only required for the CPU to start execution of the program of the required software effect plug-in to thereby enable the function when the synthesizer 10 issues an activation instruction. A plurality of programs of software effects have been here installed in the PC 30, so that the TE server can selectively activate a program designated by the activation instruction to enable a desired effector function.

The mixer 313 has a function as a setting device for a signal input/output path. More specifically, the mixer 313 has a function of determining to send the waveform data processed in which module to which module next, according to the instruction from the synthesizer 10. For example, the mixer 313 outputs the stereo waveform data generated and outputted by the tone generation module 312 to the effector 314 and another apparatus in charge of the effect processing, supplies the waveform data transmitted from the apparatus in charge of the tone generation function to the effector 314, or so on.

The UI control program memory 315 is a memory which stores the UI control program that is an edit operation accepting program for realizing functions of accepting, via the operation panel 15 of the synthesizer 10, an edit operation of the timbre data to be used by the tone generation module 312 and the effect data to be used by the effector 314 and causing the tone generation module 312 and the effector 314 to edit the data according to the operation.

The UI control program has been prepared to provide a UI suitable for edit of the data to be used by the module for each of the tone generation module 312 and the effector 314 that can be activated by the TE server 310, and is preferably stored in the UI control program memory 315 while associated with programs for realizing the functions of the tone generation module 312 and the effector 314 when the programs are installed. As a matter of course, the UI control program can be solely updated later.

Further, the UI control program memory 315 may store a UI control program for PC for realizing the function of causing the PC 30 to accept an edit operation of the timbre data or the effect data via the display, the mouse or the like and edit them.

The functions of the mixer 313 and the UI control program memory 315 are enabled when the TE server 310 is activated and kept in enabled states until the TE server 310 stops.

Figure 3:
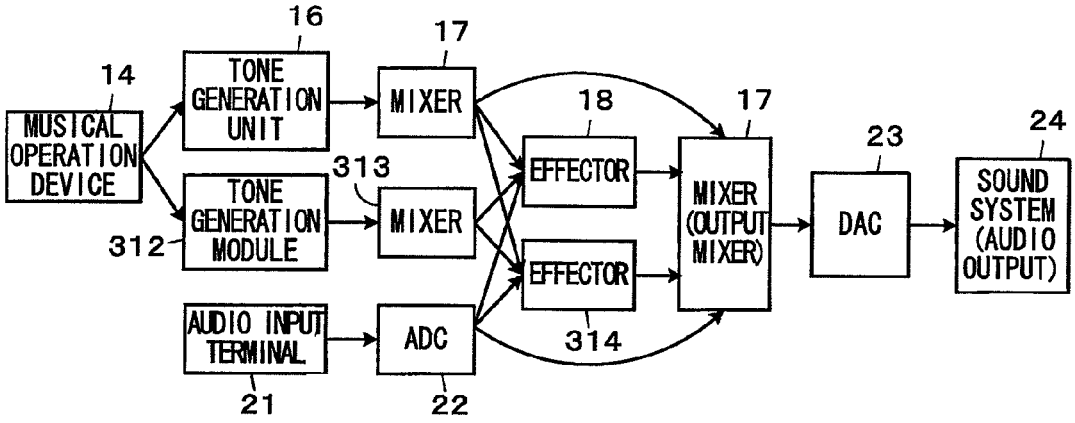
FIG. 3 is a connection conceptual diagram of signal processing elements shown in FIG. 2.

A connection conceptual diagram of signal processing elements shown in FIG. 2 is shown here in FIG. 3. In this drawing, portions where arrows branch off mean that one of the branches is selected as the output destination to which a signal is outputted.

As is clear from this drawing, the synthesizer 10 and the PC 30 having the functions shown in FIG. 2 are connected to constitute a system, whereby the tone generation section arbitrarily selected from among the internal tone generation unit 16 and the tone generation module 312 provided by the external apparatus can generate waveform data according to the musical operation and the like on the musical operation device 14, and the effector section arbitrarily selected from among the internal effector 18 and the effector 314 provided by the external apparatus can impart sound effect to the waveform data and output the resulting waveform data.

Further, the effector section arbitrarily selected from among the internal effector 18 and the effector 314 provided by the external apparatus can impart sound effect even to the waveform data inputted from the sound input terminal 21 and output the resulting waveform data.

The selection of the tone generation unit and the effector to be used in this event can be independently performed on the synthesizer 10 side. The waveform data can be outputted without passing through the effector.

Figure 4:
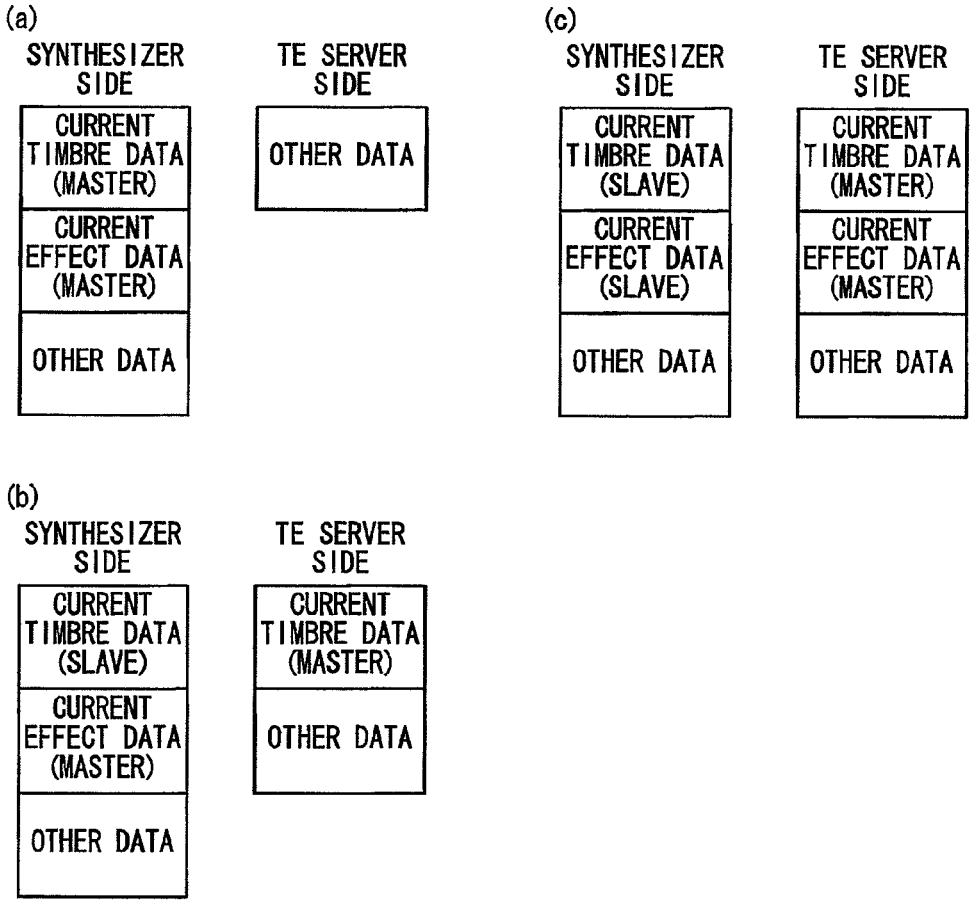
FIG. 4 is a view showing configurations of data stored in current memories on a synthesizer side and on a TE server side.
Figure 5:
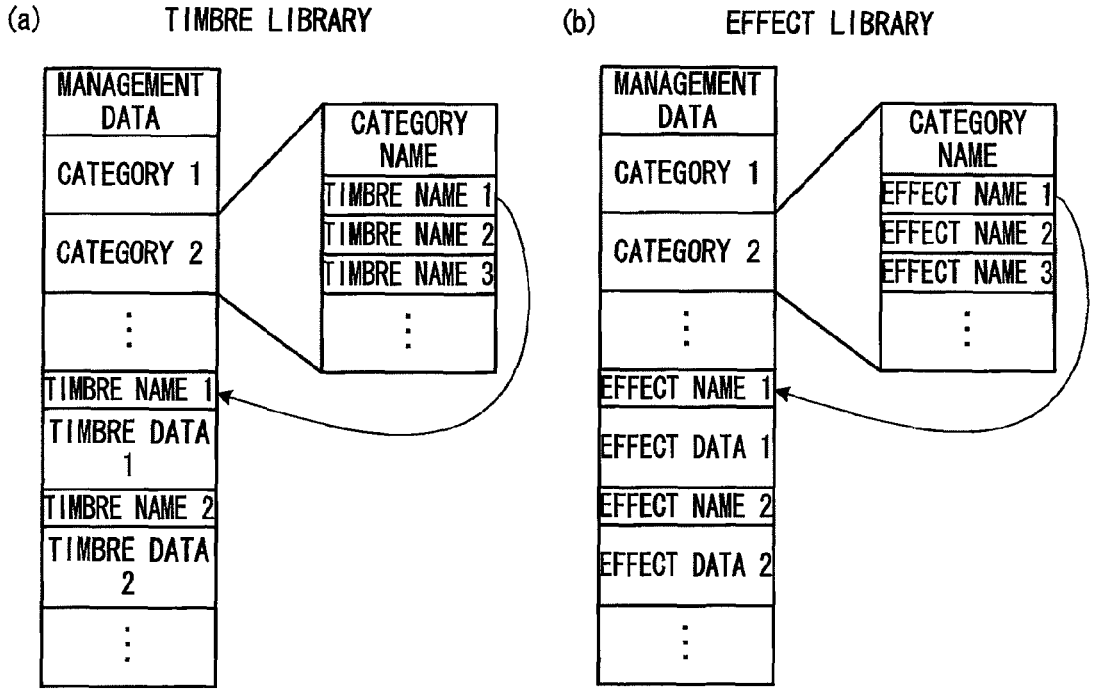
FIG. 5 is a diagram showing configurations of libraries included in the synthesizer.

Further, configurations of data to be stored in the current memories on the synthesizer 10 side and the TE server 310 side are shown in FIG. 4, and configurations of libraries included in the synthesizer 10 are shown in FIG. 5.

Each of the current memories shown in FIG. 4 is a memory storing current timbre data defining the tone color of the waveform data generated by the tone generation unit and current effect data defining the characteristic of the sound effect imparted by the effector. The tone generation unit/module and the effector read the timbre data and the effect data from the corresponding current memory and generate the waveform data or impart sound effect according to the contents.

Though the current memory is not shown in FIG. 2, it may be provided in a suitable area in the RAM. If the tone generation unit or the effector have dedicated RAMs, they may be provided in the RAMs.

In FIG. 4, the configurations of the current memories are shown: (a) showing a case of using internal units of the synthesizer to both for the tone generator and the effector; (b) showing a case of using the tone generator provided by the TE server 310 and the internal effector of the synthesizer 10; and (c) showing a case of using functions provided by the TE server 310 both for the tone generator and the effector.

As is clear from the drawings, only when the tone generator and the effector provided by the TE server 310 are used, the current memory area used by those modules is provided on the TB server 310 side.

On the synthesizer 10 side, not only when the internal tone generator and effector are used, but also when the external modules are used, the current memory storing the data to be used by those modules is provided. The area storing the data to be used by the external modules, however, is provided as a slave area, and the external modules never directly refer to the data stored therein when the external modules generate the waveform data or performs effect processing.

The current memory (slave) is provided so that when the screen of the synthesizer 10 is switched to a screen showing parameters of the external modules (for example, later-described screens shown in FIG. 29 and FIG. 30), a new screen can be displayed without inquiring the parameter values, since the switch between the screens delays if the parameter values to be displayed on the screen are inquired to the PC 30. Accordingly, even if the slave memory area is not provided, there is no influence on the operations themselves of the tone generator and the effector, but only the display response when switching between the screens slightly delays.

The synthesizer 10 further stores candidates for the timbre data to be used by the tone generation unit 16 as a timbre library as shown in FIG. 5(*a*). In this library, a plurality of pieces of timbre data corresponding to various kinds of timbres are stored with timbre names given and sorted into categories.

When the user selects a timbre to be used, timbre data corresponding to the timbre is read and stored into the current memory shown in FIG. 4. This allows the tone generation unit 16 to generate waveform data using the selected timbre data.

Further, the timbre data read and stored into the current memory and thereafter edited can also be written over or newly registered in the timbre library 106.

The candidates for the effect data to be used by the effector 18 are stored as an effect library as shown in FIG. 5(*b*). The configuration and use are the same as those of the above-described timbre library.

Further, in the TE server 310, the tone generation module 312 and the effector 314 have corresponding timbre library and the effect library respectively, and their configurations are the same as those shown in FIG. 5. When using those modules, data is read from the corresponding libraries and stored into the current memory on the TE server 310 side, whereby the modules can perform processing according to the desired timbre data or effect data.

Figure 6:
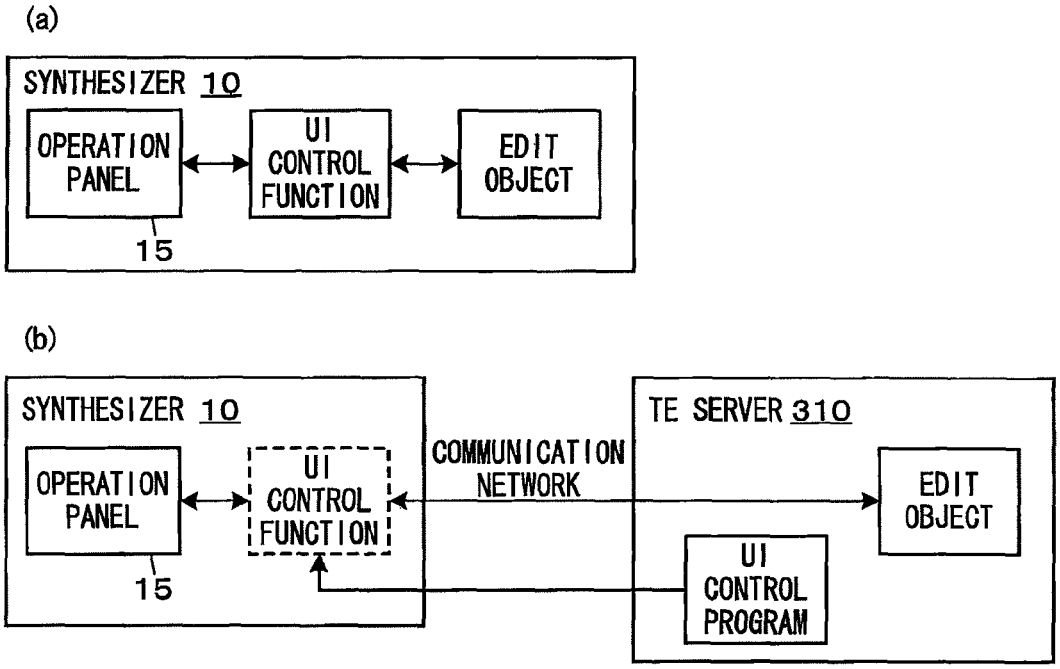
FIG. 6 is a connection conceptual diagram between an operation panel in the synthesizer and a control object.

Next, a connection conceptual diagram between the operation panel 15 in the synthesizer 10 and a control object is shown in FIG. 6.

In the synthesizer 10, the user can edit the data being used by the tone generation unit and the effector, that is, the timbre data and the effect data stored in the current memory by the operation from the operation panel 15.

Regarding the edit of the data to be used by the internal tone generation unit 16 and effector 18, it is possible to prepare the UI control function suitable for those edit on the synthesizer 10 side because the configuration of the data is known in advance.

However, regarding the edit of the data to be used by the external tone generation module 312 and effector 314, it is impossible to prepare the UI suitable for those edit in advance because the configuration of data to be edited is unknown. Hence, the UI control program corresponding to an edit object is downloaded from the TE server 310 including the edit object, and executed to realize the UI control function.

This allows the edit to be performed in the synthesizer 10 using the UI suitable for the edit of data to be used by the tone generation module 312 and the effector 314 which has been prepared by the vender of the modules so as to realize convenient edit operation.

Next, processing which the CPUs of the synthesizer 10 and the PC 30 having the above-described configurations execute to enable the synthesizer 10 to use the functions of the TE server will be described.

Figure 7:
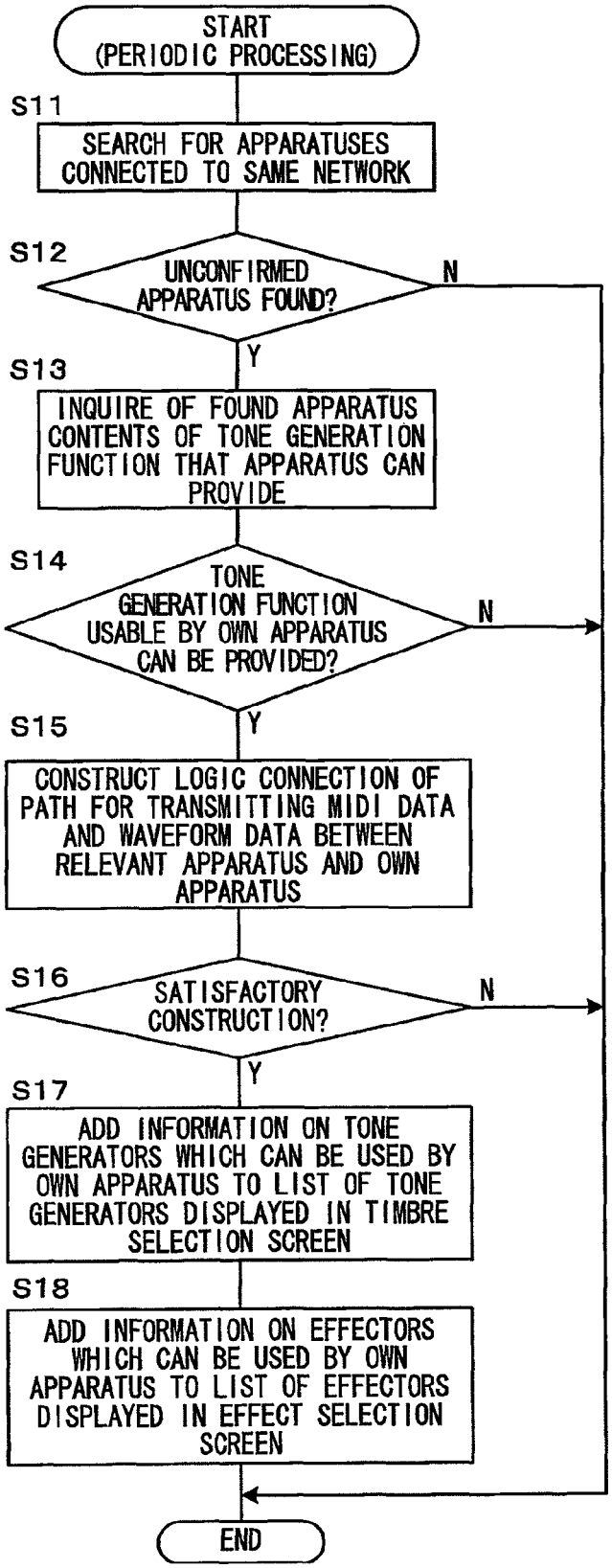
FIG. 7 is a flowchart of connection confirmation processing periodically executed by a CPU of the synthesizer.

First, a flowchart of connection confirmation processing periodically executed by the CPU 11 of the synthesizer 10 is shown in FIG. 7. Further, a flowchart of TE demon processing executed by the CPU 31 of the PC 30 is shown in FIG. 8.

The CPU 11 of the synthesizer 10 starts the processing shown in FIG. 7 at a periodical timing to search for apparatuses connected to the same network (S11). This search is to search what apparatuses are connected within a range in which the MIDI data and the waveform data can be transmitted at real time via the communication I/F 19, and can be performed by an appropriate protocol according to the communication standards. Based on the result of search in the past, the CPU 11 saves information indicating what apparatuses are connected to the network.

The CPU 11 then judges whether or not an unconfirmed apparatus has been found by the search in Step S11 (S12), and if any unconfirmed apparatus has been found, the CPU 11 inquires of the found apparatus the contents of a TE function that the apparatus can provide (S13). The unconfirmed apparatus here means an apparatus which has not been searched in the previous search or an apparatus from which the information of its TE function has not been acquired.

Figure 8:
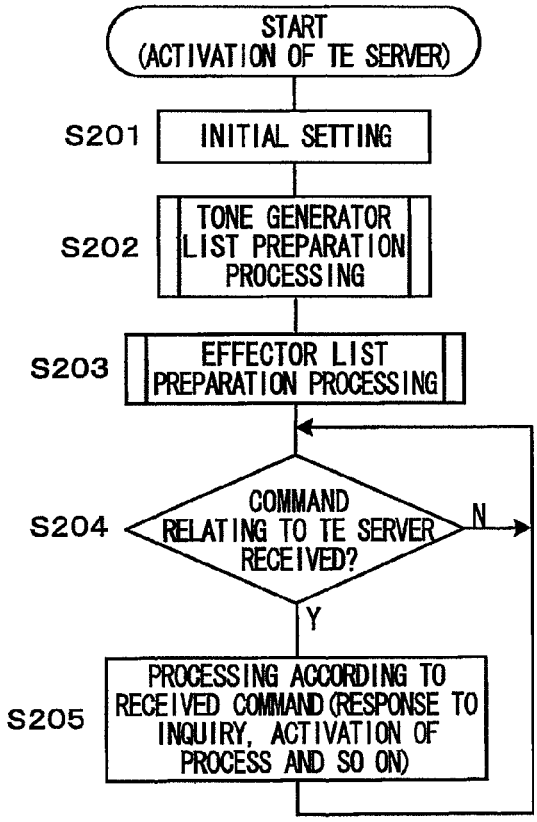
FIG. 8 is a flowchart of TE demon processing executed by a CPU of the PC.

On the other hand, the CPU 31 of the PC 30 starts the TE demon processing shown in FIG. 8 automatically when the power of the PC 30 is turned on or in response to the activation instruction by the user. This processing is processing to realize the entire control function of the TE server 310, and the CPU 31 executes this processing as a background service or a system process.

In this processing, the CPU 31 performs the required initial setting (S201), and then performs tone generator list preparation processing to maintain the tone generator list indicating the contents of the tone generation functions (by each tone generation module 312) which can be provided by the TE server 310 (S202). Thereafter, the CPU 31 performs effector list preparation processing to maintain of the effector list indicating the contents of the effect functions (by each effector 314) which can be provided by the TE server 310 (S203).

Figure 9:
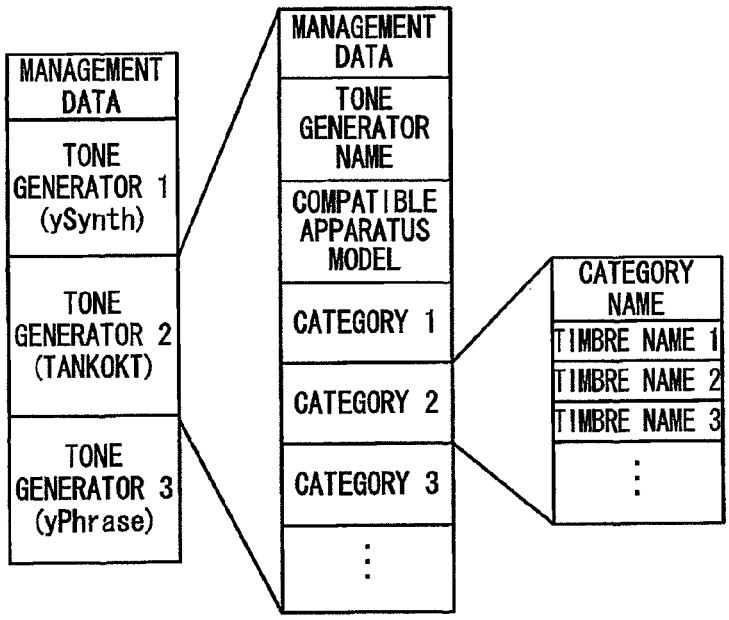
FIG. 9 is a view showing an example of a tone generator list for which maintenance is done in the TE demon processing shown in FIG. 8.

An example of the lists to be maintained in the processing in Steps S202 and S203 is shown in FIG. 9 taking the tone generator list as an example.

This list describes, as shown in FIG. 9, information of the tone generator name, the compatible apparatus models, and the names and the categories of timbres usable by the tone generator, as the information on the tone generator for each tone generation module 312 which can be activated by the TE server 310. The names of the tone generator, category and timbre should include identification information such as numbers and so on. FIG. 9 shows an example where three tone generation modules of ySynth, TANKOKT, and yPhrase can be activated.

The effector list describes information of the effector name, the compatible apparatus models, and the names and the categories of effects usable by the effector, as the information of the effector for each effector 314 which can be activated by the TE server 310. The data configuration is the same as that of the tone generator list.

The preparation processing of these lists will be described later.

In the processing in FIG. 8, after Step S203, the CPU 31 waits until it receives a command relating to the TE server 310 (S204), and when it receives the command, the CPU 31 executes processing according to the received command (S205). This processing is, for example, response to the inquiry, activation of the process, and so on shown in FIG. 10. Then, after the processing, or instructing another process to execute the processing, the CPU 31 returns again to Step S204 and waits for the next command.

Returning here to the description of FIG. 7, the inquiry performed by the CPU 11 in Step S13 is performed by a TE function inquiry command which can be accepted by the TE demon. When receiving that command with the TE demon being activated, the PC 30 refers to the tone generator list and the effector list as shown in FIG. 10, and gives a reply of information on the tone generator names, the effector names, and respective compatible apparatus models in the lists.

When receiving the reply to the inquiry in Step S13, the CPU 11 of the synthesizer 10 judges whether or not the apparatus of the inquiry destination (the PC 30 here) can provide the TE function that the own apparatus (the apparatus including the CPU 11 itself, that is, the synthesizer 10 here) can use, based on the information on the compatible apparatus models (S14). Note that when the TE demon is not activated in the apparatus at the inquiry destination, there is no reply to the inquiry, and therefore the judgment in Step S14 is NO in this case.

When NO in Step S14, the CPU 11 ends the processing, but when YES, the CPU 11 constructs a logic connection of a path for transmitting the MIDI data and the waveform data between the apparatus which sent the reply and the own apparatus (S15). In this event, the CPU 11 makes necessary setting on the synthesizer 10 side and transmits a logic connection request shown in FIG. 10 to the TE server 310.

Figure 11:
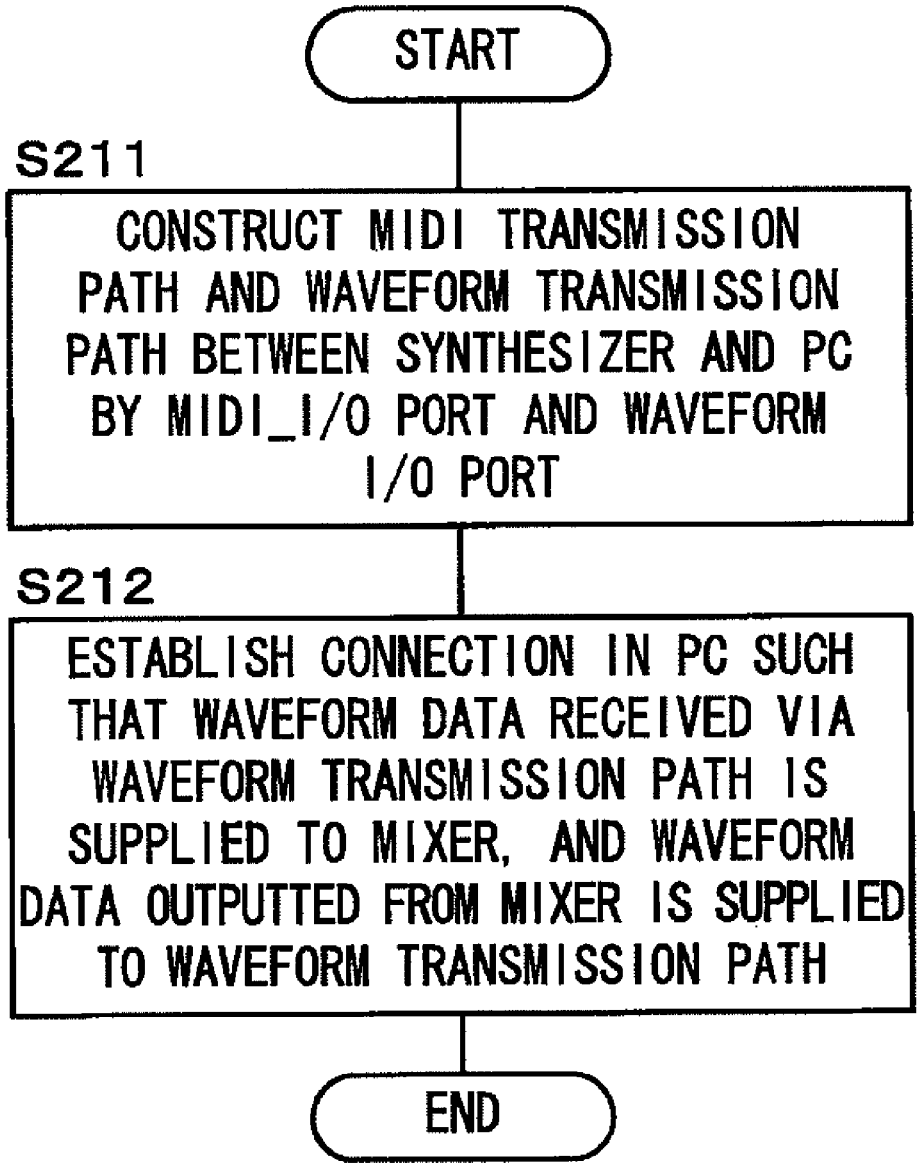
FIG. 11 is a flowchart of processing of constructing a logic connection executed by the CPU of the PC in response to a logic connection request.

A flowchart of processing of constructing the logic connection executed by the CPU 31 in response to the logic connection request is shown in FIG. 11. Step S211 in this processing is executed by the CPU 31 in conjunction with the CPU 11 on the synthesizer 10 side. More specifically, the CPU 11 and the CPU 31 cooperate to set, in the network 50, the real-time transmission path (a MIDI transmission path) for the MIDI data from the synthesizer 10 to the PC 30 and the bi-directional real-time transmission path (a waveform transmission path) for the waveform data between the synthesizer 10 and the PC 30.

The CPU 31 then establishes a connection such that the waveform data received via the waveform transmission path is supplied to the process of the mixer 313, and establishes a connection such that the waveform data outputted from the process of the mixer 313 is supplied to the waveform transmission path in the PC 30 (S212). Note that though there is no module in the TE server 310 to process the MIDI data received via the MIDI transmission path until the tone generator control module 311 is activated, a temporary connection may be established so that the MIDI data received via the MIDI transmission path is supplied to the TE demon.

On the synthesizer 10 side, the CPU 11 establishes a connection such that when the MIDI data from the selector 102 is outputted to the external tone generator, the MIDI data is supplied to the MIDI transmission path, the waveform data received via the waveform transmission path is supplied to the mixer 17, and the waveform data outputted from the mixer 17 is supplied to the waveform transmission path.

Through such processes, the units/modules on the synthesizer 10 side and the modules on the PC 30 side are connected via the MIDI transmission path and the waveform transmission path, whereby expansion of the tone generator and effector functions by the PC 30 becomes possible. Such a state will be called a "logic connection established state."

Returning again to the description of FIG. 7, when the CPU 11 can confirm the satisfactory construction of the logic connection in Step S15 (S16), the CPU 11 adds the information on the tone generators which can be used by the own apparatus to the list of tone generators displayed in a later-described timbre selection screen (S17), and adds the information on the effectors which can be used by the own apparatus to the list of effectors displayed in a later-described effector selection screen (S18), based on the information acquired in Step S13, and then ends the processing.

Note that if the CPU 11 cannot confirm the satisfactory construction within a predetermined time after Step S15, the CPU 11 judges that the construction is failed in Step S16, and ends the processing.

After completion of the above processing, the user of the synthesizer 10 can select use of the timbre included in the tone generation module 312 that can be activated by the TE server 310 and the effect included in the effector 314 that can be activated by the TE server 310, to thereby activate the tone generation module 312 and the effector 314.

The user does not need to perform any setting operation to the PC 30 in order to obtain such a state, but only needs to connect the PC 30 to the network to which the synthesizer 10 belongs (the TE demon needs to be activated if it is not automatically activated).

Next, processing relating to the maintenance of the tone generator list shown in FIG. 9 will be described.

The maintenance of this list is first performed in the tone generator list preparation processing in Step S202 at the time of activating the TE server.

Figure 12:
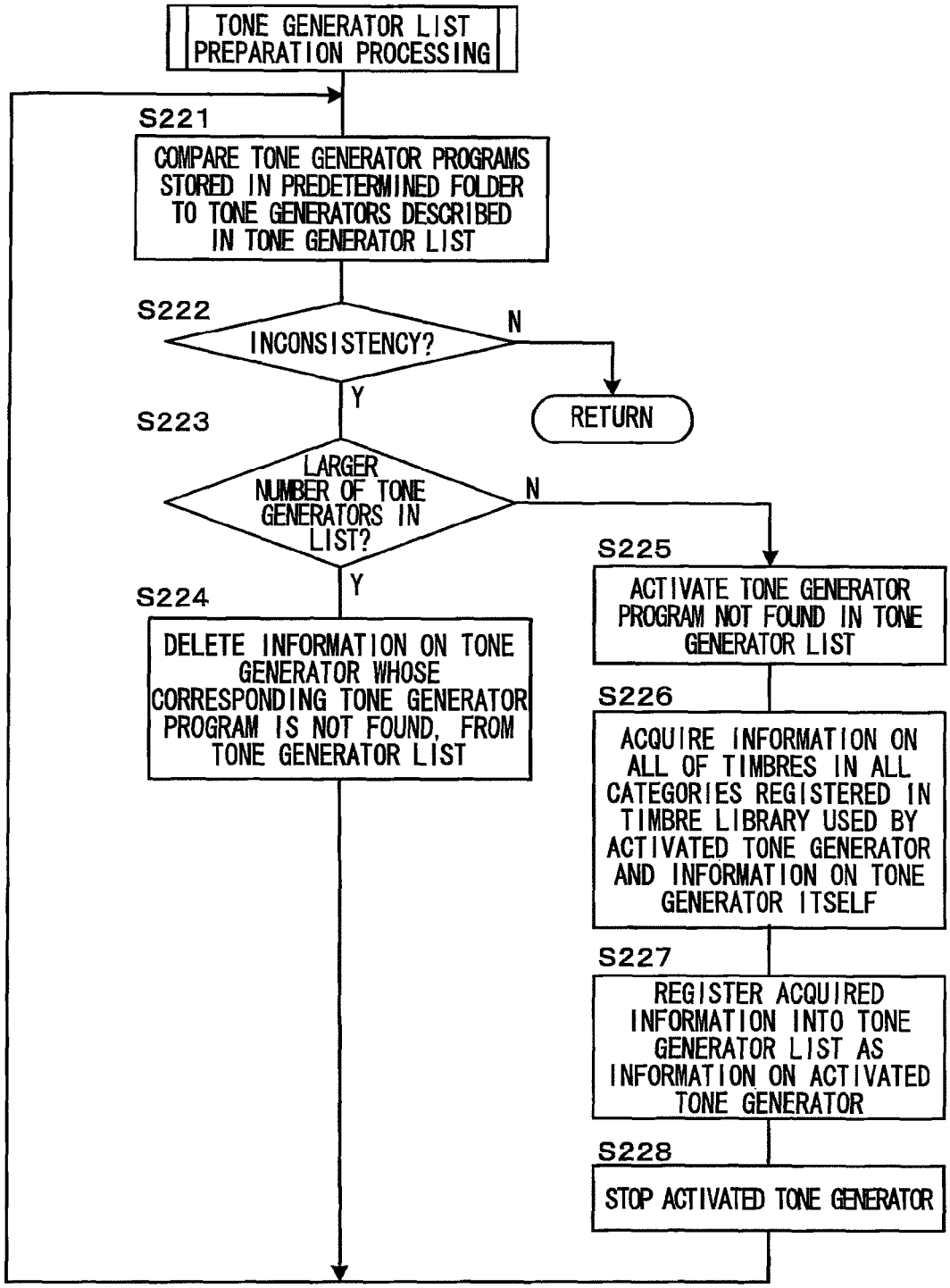
FIG. 12 is a flowchart of tone generator list preparation processing executed in the TE demon processing shown in FIG. 8.

A flowchart of the tone generator list preparation processing is shown in FIG. 12.

In this processing, the CPU 31 of the PC 30 first compares tone generator programs stored in a predetermined folder to the tone generators described in the tone generator list (S221). Note that the tone generator programs have been installed in the PC 30 as plug-ins to the TE demon, and the predetermined folder mentioned here means a plug-in folder used by the TE server 310.

When there is no inconsistency in the above comparison (S222), the CPU 31 judges that the maintenance is unnecessary here and ends the processing.

On the other hand, when there is inconsistency and if the number of tone generators described in the tone generator list is larger than the number of actually existing programs (S223), the CPU 31 judges that the tone generator program which was available in the past becomes unavailable due to uninstall or the like, and deletes the information on the tone generator whose corresponding program is not found, from the tone generator list (S224).

Conversely, if the number of actually existing programs is larger than the number of tone generators described in the tone generator list, the CPU 31 judges that a new sound program is installed, and activates the program so as to acquire the information on the tone generator program not found in the tone generator list (S225). The CPU 31 acquires the information on all of the timbres in all categories registered in the timbre library used by the tone generator activated by the program and the information on the tone generator itself (S226).

The CPU 31 then registers the acquired information in the tone 10 generator list as the information on the activated tone generator (S227) and stops the activated tone generator (S228).

After Step S224 or S228, the CPU 31 returns to Step S221 and repeats the processing.

By the above processing, even when addition or deletion of a tone generator program is performed while the TE demon is not activated, its contents can be reflected when the TE demon is activated.

Note that though the CPU 31 actually activates the tone generator program only for the difference from the tone generator list when activating the TE demon to acquire the information on the tone generator and the timbre here, the CPU 31 may activate all of the tone generator programs stored in the predetermined folder to acquire the information on the tone generators and the timbres, and recreate a new tone generator list in the tone generator list preparation processing. When such processing is performed, the time required to create the tone generator list increases, but an accurate list reflecting the latest information can be created.

For the tone generator list for which the maintenance has been done by the above processing, the CPU 31 registers notified information in the tone generator list to maintain the tone generator list according to the notification of the timbre information transmitted when the tone generator control process which has been once activated is stopped as described later, even during activation of the TE demon. Further, when the TE demon is stopped, the tone generator list at the point in time is saved so that the list can be referred to at the next activation time (see FIG. 10).

Though the maintenance of the tone generator list has been described here, maintenance can be similarly done on the effect list by comparing effector programs stored in a predetermined folder to the effectors described in the effector list and performing the similar processing.

Next, the operation when selecting the timbre and effect to be used in performance in the synthesizer 10 will be described.

First, a portion of the operation panel 15 included in the synthesizer 10 and a display example of the TE setting screen displayed on the operation panel are shown in FIG. 13.

The operation panel 15 of the synthesizer 10 is provided with a touch panel 151, a cursor key 152, a rotary encoder 153, a TE setting key 154, and an EXIT key 155 as controls for accepting the setting operation relating to the timbre and effect.

Among them, the touch panel 151 is made by stacking a touch sensor on a liquid crystal display, for displaying a GUI screen and accepting the operation on the GUI.

The cursor key 152 is a key for operating the position of the cursor in the screen displayed on the touch panel 151.

The rotary encoder 153 is a knob for instructing an increase/decrease in the value of the parameter corresponding to the position of the cursor in the screen displayed on the touch panel 151.

The TE setting key 154 is a button for recalling a TE setting screen 400 shown in FIG. 13 on the screen of the touch panel 151.

Figure 29:
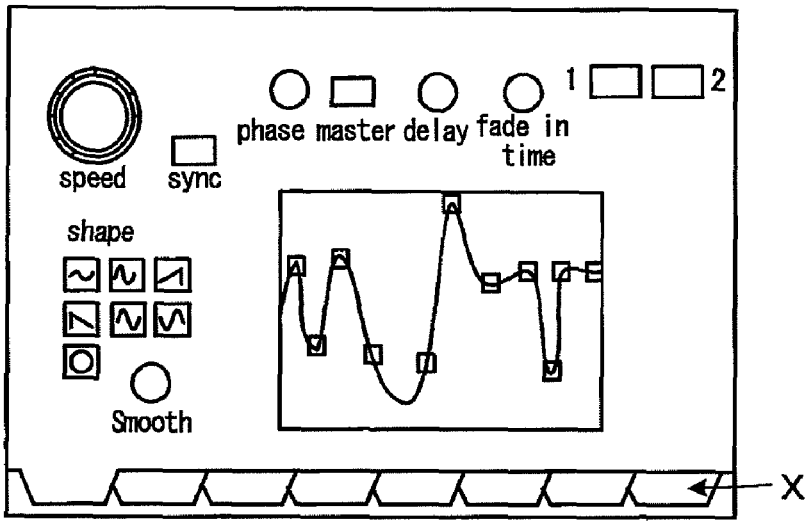
FIG. 29 is a view showing an example of a parameter edit screen displayed on a touch panel of the synthesizer by a UI control program downloaded from the TE server.
Figure 30:
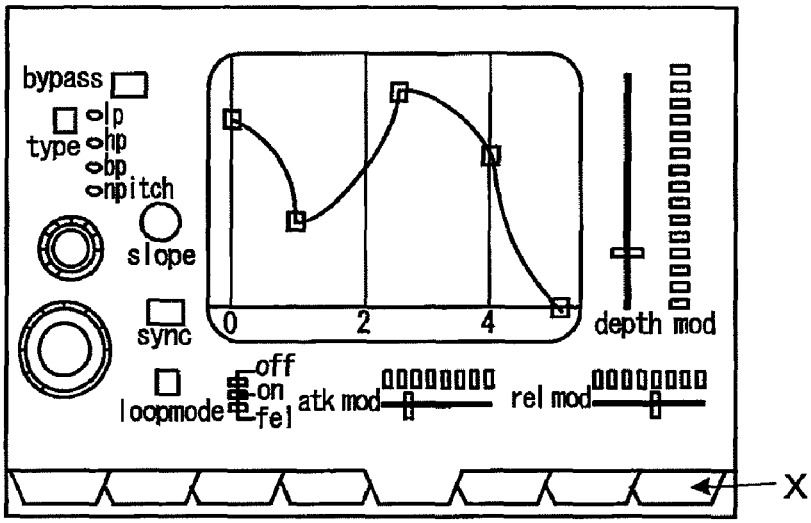
FIG. 30 is a view showing a state in which the display in the screen is switched by touching a tub in the screen in FIG. 29.

The EXIT key 155 is a button for switching the screen displayed on the screen of the touch panel 151 to the screen of a next upper hierarchy, and if it is operated when a later-described parameter edit screen as shown in FIG. 29 or FIG. 30 is being displayed, the screen is switched to the TE setting screen 400, while if it is operated when the TE setting screen 400 is being displayed, the screen is switched to the top screen of the synthesizer 10.

The TE setting screen 400, which is a screen for displaying the timbre and the effect which are being currently used by the synthesizer 10 and accepting the operation for recalling a screen for changing the timbre and the effect, is the top screen for a function for accepting the settings relating to the timbre and the effect.

On this screen, the names of the timbre and the effect to be used in outputting the musical sound in response to the musical operation on the keyboard constituting the musical operation device 14 are displayed in a timbre name display area 402 and an effect name display area 412. In an effect name display area 422, the name of the effect to be used in processing the sound inputted from the sound input terminal 21 is displayed.

In these display. areas, the names of the tone generator and the effector in charge of the waveform data generation and the processing of the effect are displayed in parentheses, and the names of the timbre and the effect are displayed outside the parentheses.

A timbre selection button 401 is a button for displaying the screen for accepting selection of a timbre to be used, and effect selection buttons 411 and 421 are buttons for displaying the screens for accepting selection of the effects to be used.

A timbre edit button 404 and effect edit buttons 414 and 424 are buttons for displaying the screens for editing the contents (parameters) of the timbre and effects which are currently selected and displayed in the corresponding display areas 402, 412 and 422.

A timbre store button 403 and effect store buttons 413 and 423 are buttons for storing the edit results in the libraries. The user can select overwrite store or new store of the timbre or the effect in a not-shown store screen which is displayed when the button is pressed, and in the case of new store, the timbre or the effect can be stored with the category and the name designated.

Next, a display example of the timbre selection screen is shown in FIG. 14.

A timbre selection screen 430 is a screen displayed when the timbre selection button 401 is pressed in the TE setting screen 400.

A tone generator selection area 431 is an area for displaying a list of tone generators which can be currently used from the synthesizer 10 and accepting selection of a tone generator to be used. "Internal" shows the internal tone generation unit 16, and the other tone generators show the tone generation functions provided by the external TE server 310. Accordingly, when the synthesizer 10 is used by itself, only "Internal" is displayed in the tone generator selection area 431. As the display showing the tone generators except "Internal," the name of the TE server providing the function of the tone generator is displayed in front of colon and the name of the tone generator is displayed behind the colon.

A category selection area 432 is an area for displaying a list of timbre categories included in the tone generator currently selected in the tone generation area 431, and accepting selection of the category of a timbre to be used.

A timbre selection area 433 is an area for displaying a list of timbres included in the category currently selected in the category selection part 432, and accepting selection of a timbre to be used.

Scroll bars 434 and 435 are operation areas for scrolling the displays in the category selection area 432 and the timbre selection area 433. If any more tone generators cannot be displayed in the tone generator selection area 431, a scroll bar corresponding to the tone generator selection area 431 is also displayed.

The timbre selection screen 430 is displayed at first with the already selected timbre, the category in which the timbre is included, and the tone generator having the timbre being highlighted (shown with hatchings in the drawing). By touching another timbre in the timbre selection area 433, the timbre can be selected.

By touching another category in the category selection area 432, the list of timbres included in that category can be displayed in the timbre selection area 433. Further, by touching another tone generator in the tone generator selection area 431, the list of timbre categories included in the tone generator can be displayed in the category selection area 432, and assuming selection of the first category, the list of timbres included in the first category is displayed in the timbre selection area 433.

Note that the operations on the tone generator selection area 431 and the category selection area 432 change the highlighted positions and the display contents in the selection areas, but do not determine the selection of the timbre, and the touch on a timbre in the timbre selection area 433 determines the selection of the timbre. After selection once, it is of course possible to change the selection by touching another timbre.

After the selection of a desired timbre, by pressing the TE setting key 154 shown in FIG. 13, the screen can be returned to the TE setting screen 400 with the selection state kept.

Note that the effect selection screen displayed when the effect selection button 411 or 421 in the TE setting screen 400 is pressed has the similar configuration and function to the timbre selection screen 430. This effect selection screen is a screen which displays a list of effectors which can be currently used from the synthesizer 10, a list of effect categories included in an effector, and a list of effects included in a category, and accepts respective selections.

Next, processing executed by the CPUs of the synthesizer 10 and the PC 30 when the timbre selection screen 430 is displayed and when the operation is performed on the screen will be described.

First, a list of variables for use in the following description is shown in FIG. 15.

In the following description, the timbre/effect, category and so on selected on the timbre selection screen 430 and a not-shown effect selection screen will be expressed by the variables shown in FIG. 15 for simplification of the description. The boxes of "tone generator/timbre" and "effector/effect" show variables indicating those actually selected and used, and the box of "cursor position on screen" shows variables indicating only those temporarily selected in the timbre selection screen 430 and the not-shown effect selection screen and highlighted. For example, the currently used effector is shown by "EFe."

Note that the reason why the variables are prepared also for the TE server is to cope also with the case of the configuration of providing the functions of the tone generator and the effector from a plurality of TE servers to the synthesizer 10.

Figure 16:
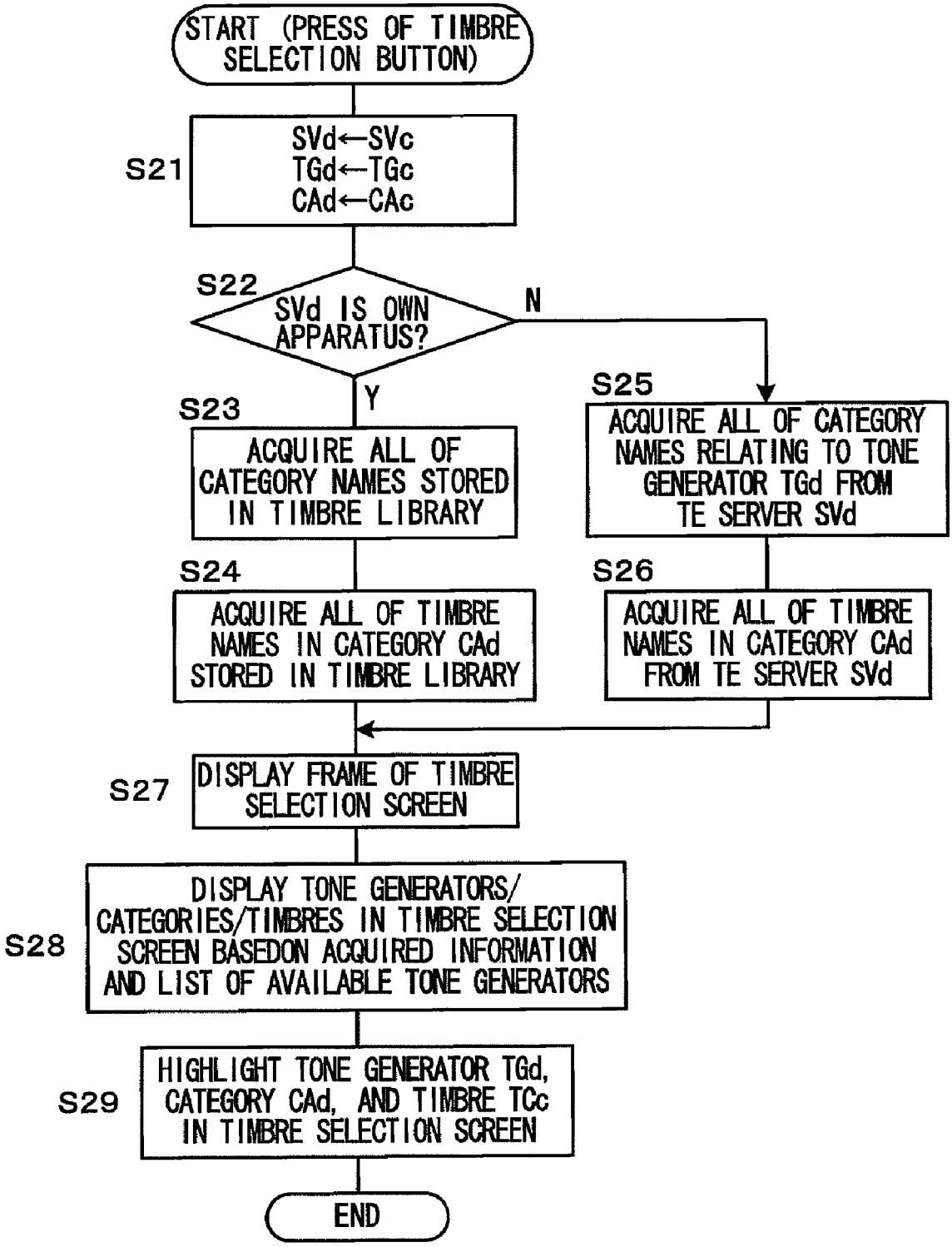
FIG. 16 is a flowchart of processing executed by the CPU of the synthesizer when it has detected a press of a timbre selection button.

Next, a flowchart of processing executed by the CPU 11 of the synthesizer 10 when it detects the press of the timbre selection button 401 is shown in FIG. 16. This processing first displays the timbre selection screen 430.

In this processing, the CPU 11 first copies the values from variables SVc, TGc, and CAc indicating the selection state relating to the current timbre to variables for display SVd, TGd, and CAd (S21). For a timbre TCc, no corresponding variable for display is prepared.

Then, in steps S22 to S26, data necessary for displaying the screen is acquired.

Specifically, when SVd indicates the own apparatus, that is, when the timbre of the internal tone generator is selected so that the information on the internal tone generator needs to be displayed in the category selection area 432 and the timbre selection area 433 in the timbre selection screen 430 (S22), the CPU 11 acquires all of the category names stored in the timbre library of the own apparatus (S23). The CPU 11 further acquires all of the timbre names in the category CAd stored in the timbre library in order to display the timbres included in the currently selected category in the timbre selection area 433 (S24).

On the other hand, when SVd indicates another apparatus, that is, when the timbre of the external tone generator is selected, the CPU 11 acquires all of the category names relating to the tone generator TGd from the TE server SVd (S25). This acquisition is performed by transmitting an inquiry command for timbre category to the TE demon of the TE server 310, and SVd is used for identifying the transmission destination of this command. Then, the CPU 11 similarly inquires the TE server SVd to acquire all of the timbre names in the category CAd (S26).

Figure 17:
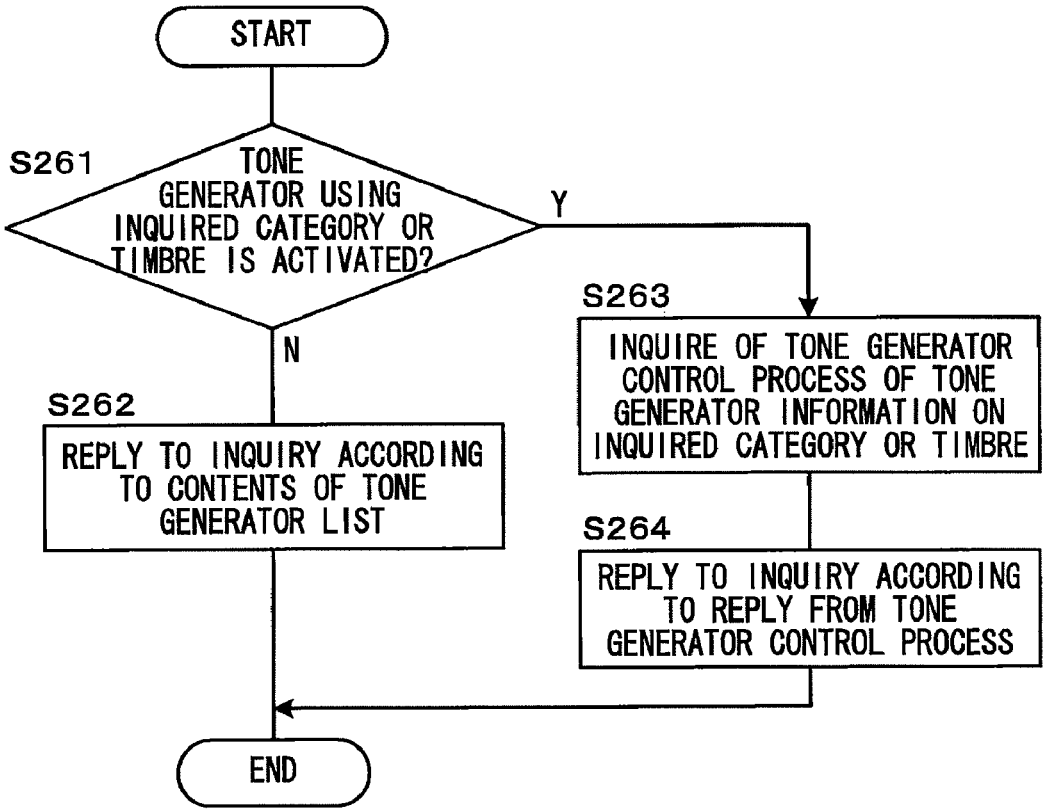
FIG. 17 is a flowchart of processing executed by the CPU of the PC when it has received an inquiry in steps S25 and S26 in FIG. 16.

A flowchart of processing executed by the CPU 31 of the PC 30 when it receives an inquiry in Steps S25 and S26 is shown in FIG. 17.

This processing is executed in Step S205 in FIG. 8 as the processing corresponding to the reception of the command as a part of the function of the TE demon as shown in FIG. 10.

In this processing, if the tone generator using the inquired category or timbre is not activated (S261), the CPU 11 replies to the inquiry according to the contents of the tone generator list shown in FIG. 9 (S262), and ends the processing.

On the other hand, if the tone generator is activated, the CPU 11 inquires of the tone generator control process of the tone generator the information on the inquired category or timbre (S223), and replies to the inquiry that the CPU 11 has received, according to the response from the tone generator control process (S224). Accordingly, in this case, the CPU 11 can reply after surely grasping the current contents.

Return to the description of FIG. 16.

The CPU 11 acquires the information necessary for display in the processing until Step S24 or S26, and then displays the frame of the timbre selection screen 430 on the touch panel 151 (S27), and displays the tone generators, categories and timbres in the respective selection areas 431 to 433 in the timbre selection screen 430 based on the information acquired thus far and the list of available tone generators maintained in Step S17 in FIG. 7 (S28). The CPU 11 then highlights the tone generator TGd, the category CAd, and the timbre TCc which are currently selected (S29), and ends the processing.

Figure 18:
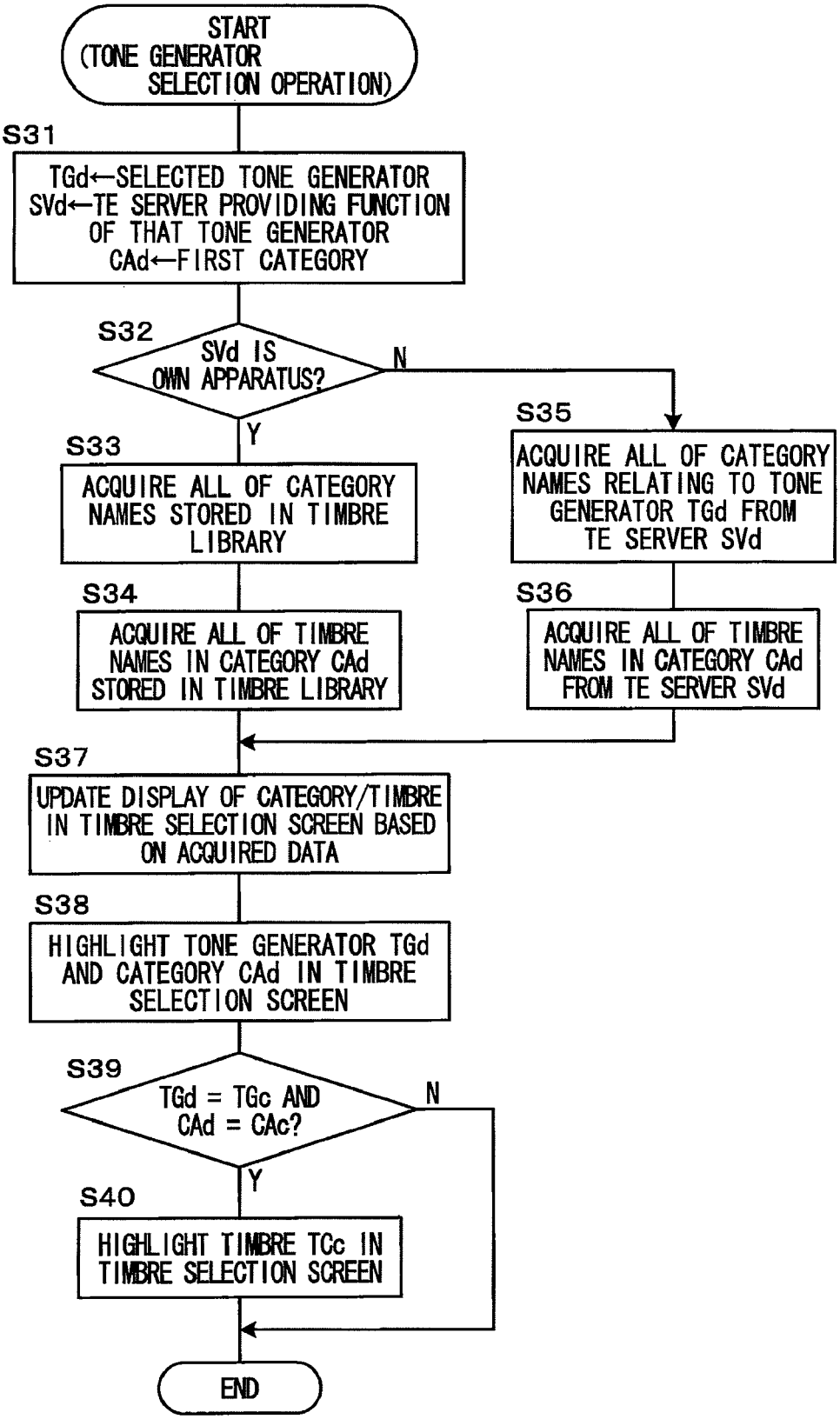
FIG. 18 is a flowchart of processing executed by the CPU of the synthesizer when it has detected the operation of selecting a tone generator in the timbre selection screen.

Next, a flowchart of processing executed by the CPU 11 of the synthesizer 10 when it detects the operation of selecting the tone generator in the timbre selection screen 430 is shown in FIG. 18.

In this processing, the CPU 11 first sets the display variable TGd to the value indicating the selected tone generator, SVd to the value indicating the TE server providing the function of that tone generator, and CAd to the value indicating the first category (S31). It is not always necessary to set CAd to the value indicating the first category, but the CPU 11 may store the category selected when the same tone generator has been previously selected, and set CAd to the value indicating that category.

The CPU 11 then acquires data necessary for displaying the screen, which processing is the same as that in Steps S22 to S26 in FIG. 16 (S32 to S36).

Thereafter, the CPU 11 updates the information on the category and the timbre in the category selection area 432 and the timbre selection area 433 in the timbre selection screen 430 based on the information acquired thus far (S37). The CPU 11 highlights the tone generator TGd and category CAd which are currently selected (S38). As for the timbre, the timbre in the category CAd of the newly selected tone generator TGd should not be selected, and therefore the CPU 11 does not highlight it, but if the category including the currently selected timbre is highlighted (S39), the CPU 11 also highlights the timbre TCc (S40).

The above processing allows the display in the timbre selection screen 430 to be updated according to the operation of selecting the tone generator. Note that for the tone generator selection area 431, the CPU 11 only changes the highlight position but not the contents of the list unless a tone generator is added or deleted.

Figure 19:
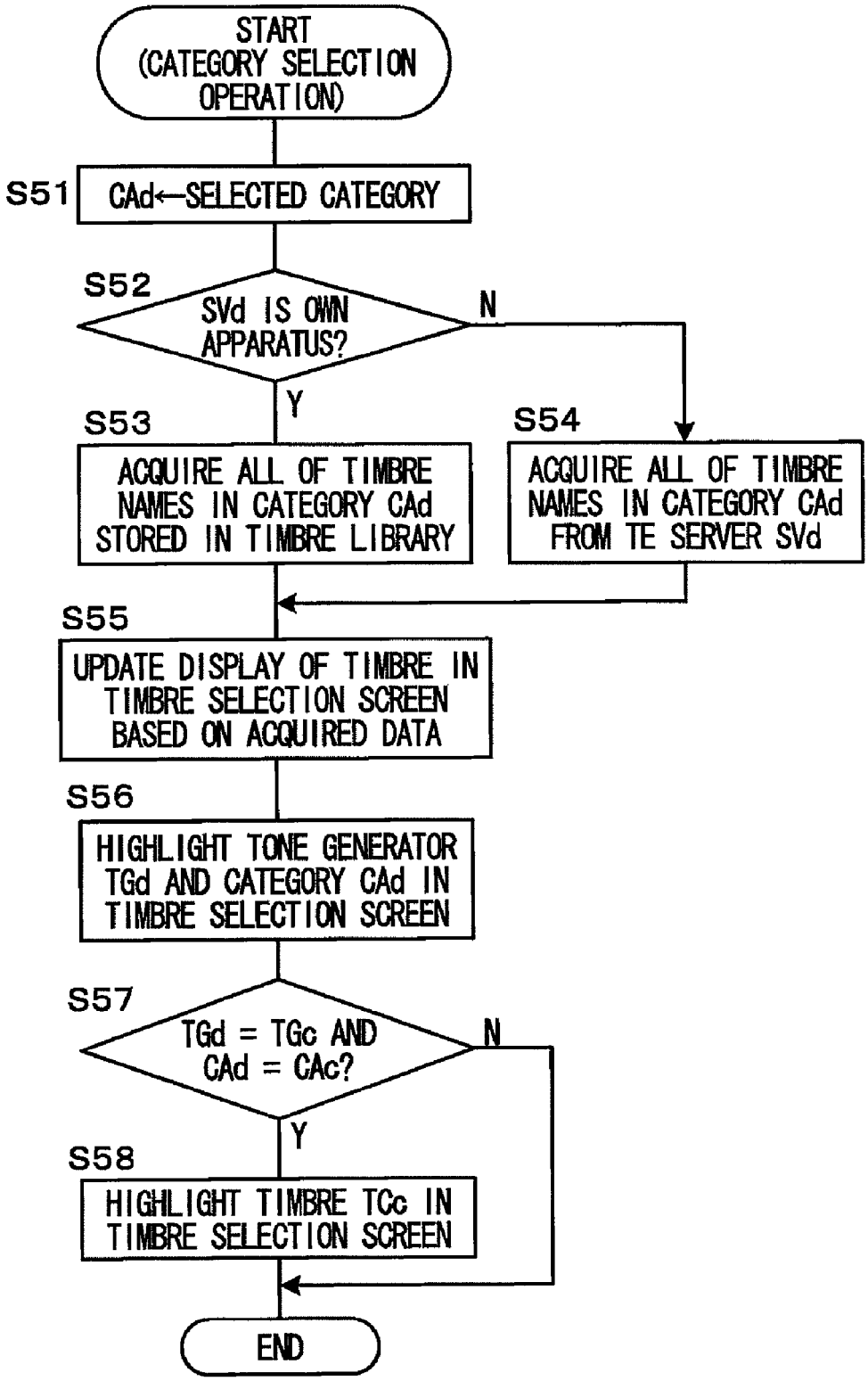
FIG. 19 is a flowchart of processing executed when detecting the operation of selecting a category in the same screen.

Next, a flowchart of processing executed by the CPU 11 of the synthesizer 10 when it detects the operation of selecting the category in the timbre selection screen 430 is shown in FIG. 19.

In this processing, the CPU 11 first sets the display variable CAd to the value indicating the selected category (S51). The CPU 11 then acquires data necessary for displaying the screen. Since it is not necessary to update the display in the category selection area 432 here, the CPU 11 only acquires the timbre name by the same processing in Steps S22, S24, and S25 in FIG. 16 (S52 to S54).

Thereafter, the CPU 11 updates the information on the timbre in the timbre selection area 433 in the timbre selection screen 430 based on the information acquired thus far (S55). The CPU 11 then highlights the tone generator TGd and category CAd which are currently selected (S56). Note that the highlight position in the tone generator area 431 is not changed from that before processing. The highlight of the timbre is the same as in Steps S39 and S40 in FIG. 18 (S57 and S58).

The above processing allows the display in the timbre selection screen 430 to be updated according to the operation of selecting the category.

Note that the processing in FIG. 16, FIG. 18 and FIG. 19 can be similarly applied to the control of the effect selection screen for accepting selection of an effect by reading SVc, TGc, CAc, and TCc as SVe, EFe, CAe, and FXe, respectively, and the tone generator as the effector, and the timbre as the effect, respectively.

Figure 20:
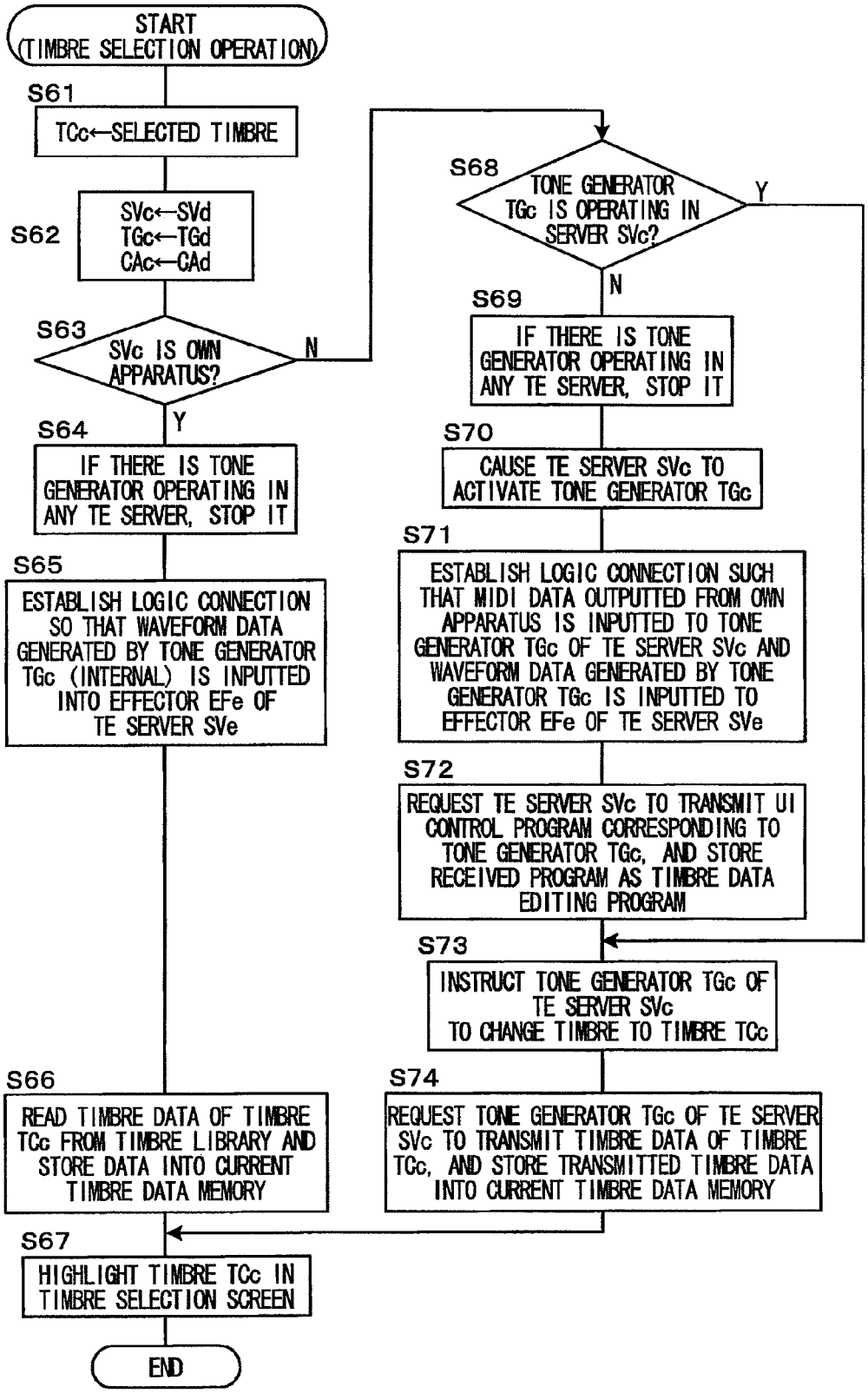
FIG. 20 is a flowchart of processing executed when detecting the operation of selecting a timbre in the same screen.

Next, a flowchart of processing executed by the CPU 11 of the synthesizer 10 when it detects the operation of selecting the timbre in the timbre selection screen 430 is shown in FIG. 20. This processing is for reflecting the selected contents of the timbre in the operations of the synthesizer 10 and the TE server.

In this processing, the CPU 11 first registers the timbre selected on the screen into TCc indicating the selected timbre (S61). The CPU 11 further copies the values of display variables SVd, TGd and CAd to the variables SVc, TGc, and CAc indicating the selection state relating to the current timbre, and thereby registers the selected contents on the screen as the determined selected contents (S62).

Next, the CPU 11 judges whether or not SVc indicates the own apparatus, that is, whether or not the timbre of the internal tone generator has been selected (S63).

When the timbre of the internal tone generator has been selected, and if there is a tone generator operating in any TE server, the CPU 11 stops the tone generator because the external tone generator is not used (S64). This processing is performed by transmitting a later-described stop instruction to the tone generator control process of the relevant tone generator. The tone generator control process which has received the instruction notifies the TE demon which has activated the tone generator control process itself of the category names and the timbre names in all of the categories to cause the TE demon to update the contents of the tone generator list, and cancels the logic connection to the MIDI_I/O 39*a* and stops (see FIG. 22 and FIG. 23).

After completion of the stop, the CPU 11 establishes a logic connection so that the waveform data generated by the tone generator TGc having the selected timbre (the internal tone generation unit 16 here) is inputted into the effector EFe of the TE server SVe that is an effector currently selected and used (S65). Note that, in this event, the logic connection between the synthesizer 10 and the TE server SVe has been already established in Step S15 in FIG. 7.

Beside, as for the MIDI data, the MIDI data generated in the MIDI data generation module 101 will be supplied to the tone generation unit 16 (the tone generator TGc) by later-described processing in FIG. 21 (corresponding to the selector 102) on the synthesizer 10 side, while the waveform data is subjected to setting processing in Step S65 different depending on whether the server SVe providing the effect is the own apparatus or the TE server of the PC 30.

Specifically, when SVe is the TE server of the PC 30, it is only necessary on the synthesizer 10 side to make setting in the mixer 17 such that the waveform data generated by the tone generation unit 16 (the tone generator TGc) is outputted to the TE server SVe via the waveform transmission path. Further, it is only necessary on the TE server SVe side to instruct the TE server SVe to make setting such that the waveform data received by the mixer 313 from the synthesizer 10 is supplied to the process of the effector EFe. This instruction can be made by the connection setting instruction shown in FIG. 10.

When SVe is the own apparatus, it is only necessary for the CPU 11 to make setting by itself in the mixer 17 such that the waveform data generated by the tone generation unit 16 (the tone generator TGc) is supplied to the effector 18 (the effector EFe) via the mixer 17.

Note that if the timbre which has been previously selected is also the timbre of the internal tone generator, it is unnecessary to establish the logic connection again here.

After completion of the logic connection, the CPU 11 reads the timbre data on the timbre TCc from the timbre library and stores the data in the current timbre data memory so that the tone generation unit 16 will use the stored timbre data when generating waveform data (S66).

Thereafter, the CPU 11 highlights the newly selected timbre TCc in the timbre selection screen 430 (S67) and ends the processing.

As shown in FIG. 2, the synthesizer 10 has the selector 102. As the processing corresponding to the function of the selector 102 (and the tone generator control module 103), the CPU 11 of the synthesizer 10 executes the processing shown in the flowchart of FIG. 21 when detecting the MIDI event, that is, when the selector 102 has received the MIDI data.

In this processing, the CPU 11 judges whether or not SVc indicates the own apparatus, that is whether or not the timbre of the internal tone generator has been selected (S81), and when it indicates the own apparatus, the CPU 11 sets the value of the channel register of the tone generation unit 16 according to the contents of the detected MIDI event to control the operation of the tone generation unit 16 (S82).

On the other hand, when NO in Step S81, that is, when the timbre of the external tone generator has been selected, the CPU 11 transmits the MIDI data indicating the detected MIDI event as it is to the TE server SVc in use (S83).

Accordingly, when SVc is changed to the own apparatus in Step S62 in FIG. 20, the CPU 11 can cause the tone generation unit 16 to generate the waveform data according to the MIDI data generated by the MIDI data generation module 101 without changing the other settings in particular.

On the other hand, when NO in Step S63 in FIG. 20, that is, when the timbre of the external tone generator has been selected, the CPU 11 judges whether or not the tone generator TGc is operating in the TE server SVc, that is, whether or not the tone generator including the selected timbre is in operation (S68).

When NO in Step S68, the CPU 11 executes the processing in Steps S69 to S72 in order to newly activate the tone generator TGc.

In this portion, if there is a tone generator operating in any TE server, the CPU 11 first causes the TE server to stop the tone generator as in Step S64 (S69).

The CPU 11 then causes the TE server SVc to activate the tone generator TGc (S70). As this processing, it is only necessary to transmit a tone generator activation instruction shown in FIG. 10 to the TE server SVc. The TE server which receives this instruction reads the program for realizing the function of the designated tone generator from the HDD 34 into the RAM 33, and starts execution of the program to activate the tone generator control process and the tone generator process relating to that tone generator. The tone generator control process is the processing corresponding to the function of the tone generator control module 311, and the tone generator process is the processing corresponding to the function of the tone generation module 312 shown in FIG. 2.

Figure 22:
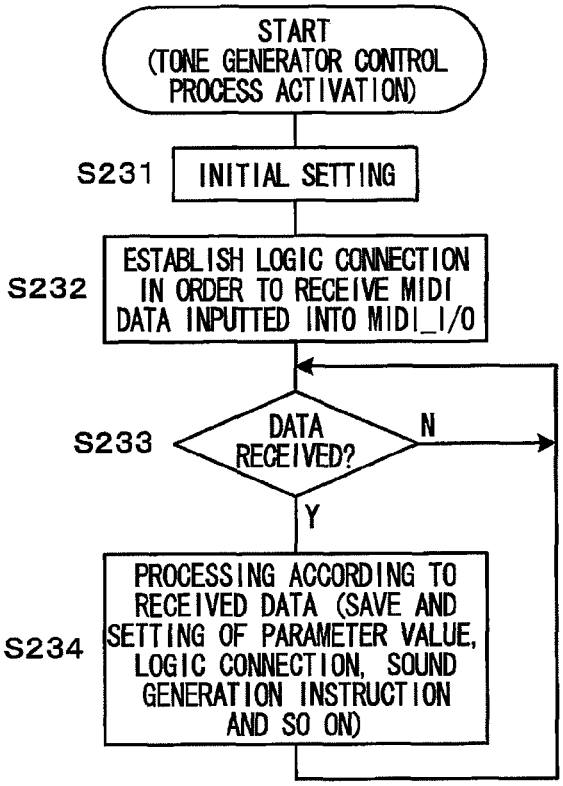
FIG. 22 is a flowchart of a tone generator control process executed by the CPU of the PC.
Figure 24:
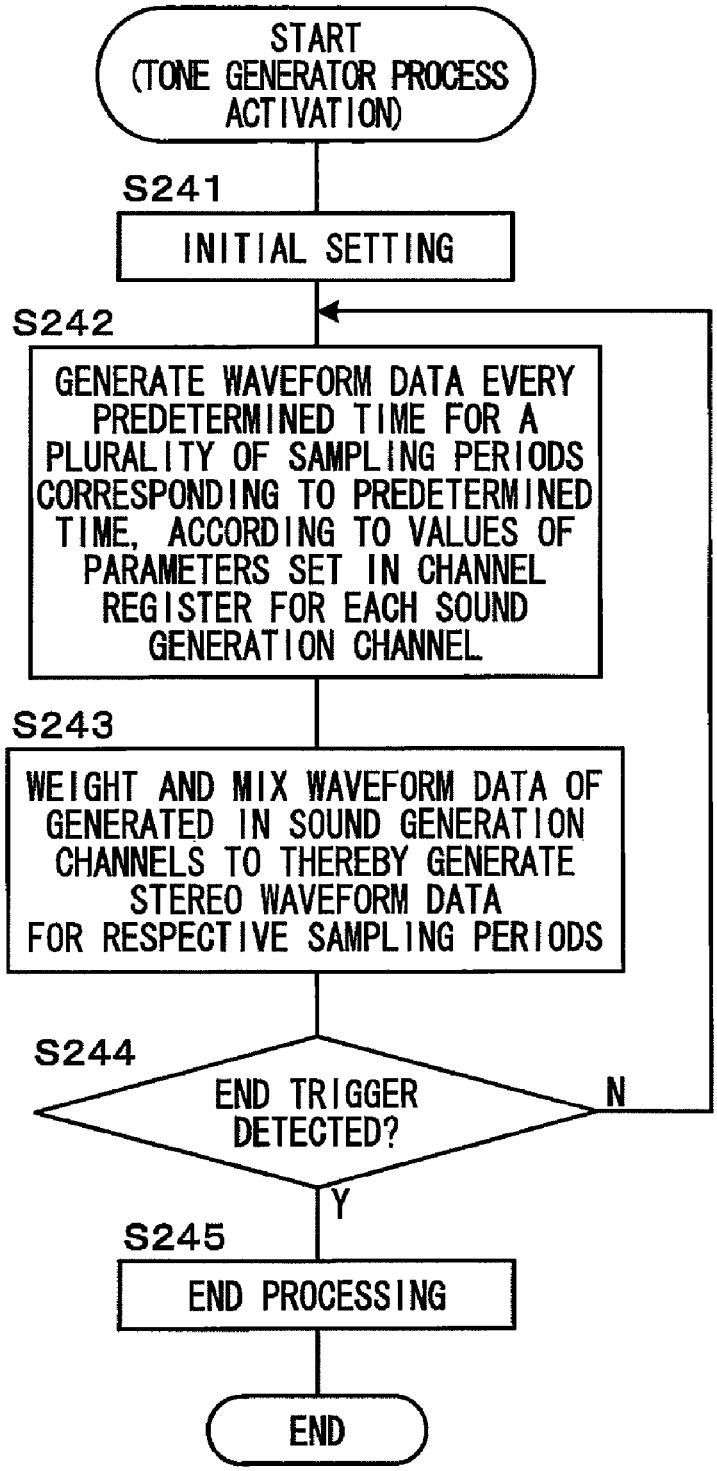
FIG. 24 is a flowchart of the tone generator process executed by the CPU of the PC.

The processing by the tone generator control process and the processing by the tone generator process activated on the PC 30 side are shown here in FIG. 22 to FIG. 24.

FIG. 22 is a flowchart regarding the tone generator control process, and this processing is executed by the CPU 31 of the PC 30 as the background service or the system process. This processing is for receiving data from the external apparatus or another process and performing processing according to the data.

More specifically, the CPU 31 makes required initial processing (S231), establishes a logic connection in order that the own process can receive the MIDI data inputted into the MIDI_I/O 39*a* (S232), then waits until receiving data (S233), and when receiving the data, executes the processing according to the received data (S234). This processing is, for example, save or setting of parameter value, sound generation instruction, data transmission, or so on as shown in FIG. 23. After completion of the processing, the CPU 31 returns again to Step S233 and waits for the next command.

FIG. 24 is a flowchart regarding the tone generator process.

When the TE demon instructs activation, the CPU 31 starts execution of this processing as the background service or the system process.

After the required initial processing (S241), the CPU 31 generates the waveform data every predetermined time for a plurality of sampling periods corresponding to the predetermined time, according to the values of parameters set in the channel register for each sound generation channel (S242). The CPU 31 weights and mixes the waveform data generated in the sound generation channels for one sampling period to thereby generate the stereo waveform data of that sampling period (S243).

The waveform data is outputted by the mixer 313 sample by sample for each sampling period to the logically connected output destination (the synthesizer 10 or the effector 314 here).

Further, in the tone generator process, the CPU 31 repeats the processing in Steps S242 and S243 until detecting an end trigger such as stop of the corresponding tone generator control process, stop of the operation of the PC 30 or the like (S244). When detecting the end trigger, the CPU 31 performs processing necessary for the completion of the process such as cancel of the logic connection and the like (S245), and ends the processing.

In the tone generator process, the CPU 31 generates the waveform data also for the later sampling period in advance in Step S242 in order to facilitate the management of output timing of the waveform data.

Returning to the description of FIG. 20, the CPU 11 causes the TE server SVc to activate the above-described tone generator control process and tone generator process for the tone generator TGc in Step S70, and then establishes a logic connection such that the MIDI data outputted from the own apparatus is inputted to the tone generator TGc of the TE server SVc and the waveform data generated by the tone generator TGc is inputted to the effector EFe of the TE server SVe (S71). Note that in this event, the logic connection between the synthesizer 10 and the TE server SVe has been already established in Step S15 in FIG. 7.

Figure 21:
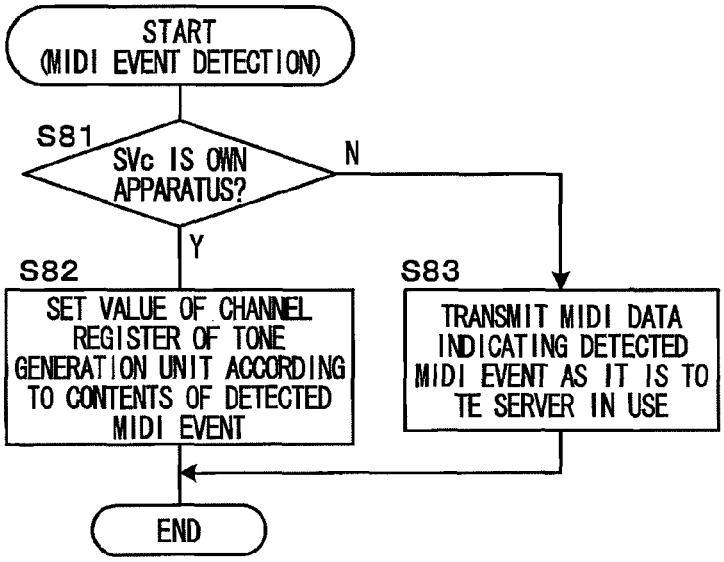
FIG. 21 is a flowchart of processing executed by the CPU of the synthesizer when it has detected a MIDI event.

As for the MIDI data, the setting processing is performed in S232 in FIG. 22 so that the MIDI data generated in the MIDI data generation module 101 will be transmitted to the TE server SVe by the processing in FIG. 21 (corresponding to the selector 102) on the synthesizer 10 side, while the received MIDI data is inputted into the process of the tone generator TGc on the TE server SVe side. Beside, the waveform data is subjected to setting processing different depending on whether the server SVe providing the effect is the own apparatus or the TE server of the PC 30.

Specifically, when SVe is the TE sever of the PC 30, it is only necessary to instruct the TE server SVc (=SVe) to make setting such that the mixer 313 supplies the waveform data generated by the process of the tone generator TGc to the effector EFe.

When SVe is the own apparatus, it is only necessary on the TE server SVc side to instruct the TE server SVc to make setting such that the mixer 313 outputs the waveform data generated by the process of the tone generator TGc to the synthesizer 10 via the waveform transmission path, and on the synthesizer 10 side to make setting by the CPU 11 itself in the mixer 17 such that the waveform data received from the TE server SVc is supplied to the effector 18 (the effector EFe).

Note that if the timbre which has been previously selected is also the timbre of the external tone generator, it is unnecessary to establish the logic connection again here.

After completion of the logic connection, the CPU 11 requests the TE server SVc to transmit the UI control program corresponding to the activated tone generator TGc, and stores the program transmitted in response to the request as a timbre data editing program (S72).

With the above, the processing relating to the activation of the tone generator TGc is competed, the CPU 11 proceeds to Step S73 and thereafter. When YES in Step S68, the CPU 11 directly proceeds to Step S73.

The CPU 11 then instructs the tone generator TGc of the TE server SVc to change the timbre to the newly selected timbre TCc (S73). This instruction can be performed by transmitting a timbre setting instruction shown in FIG. 23 to the tone generator control process of the tone generator TGc.

In response to the instruction, the tone generator control process reads the timbre data relating to the timbre TCc in the timbre library used by the process itself and stores the data into the current timbre data memory used by the tone generator process of the tone generator TGc so that the tone generator TGc will use the stored timbre data when generating waveform data.

After completion of that, the CPU 11 requests the tone generator TGc of the TE server SVc to transmit the timbre data of the timbre TCc, and stores the timbre data transmitted in response to the request into the current timbre data memory (slave) on the synthesizer 10 side (S74). This data is used to display the current values of the parameters when editing the timbre data.

Thereafter, in the timbre selection screen 430, the CPU 11 highlights the newly selected timbre TCc (S67) and ends the processing.

Through the above processing, when a timbre is selected in the timbre selection screen 430, the synthesizer 10 can enable the function of the tone generator having that timbre to establish a state in which the tone generator generates the waveform data using the selected timbre. When an external tone generator needs to be used, the CPU 11 can prepare the UI (the UI control program) suitable for editing the timbre parameters used by the tone generator.

The change on the timbre selection screen 430 by this processing is merely a change in the highlight position of the timbre.

Figure 25:
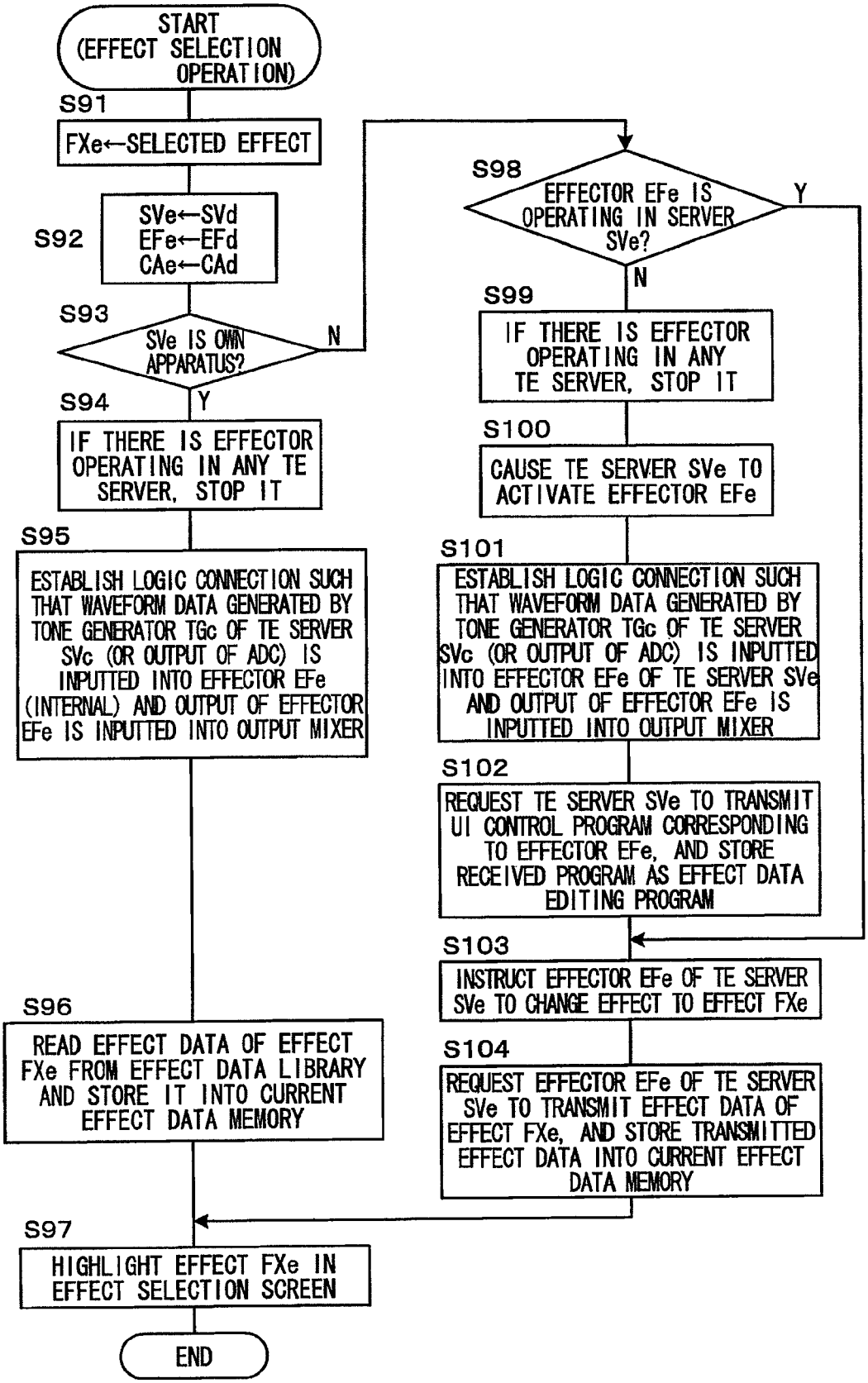
FIG. 25 is a flowchart of processing executed by the CPU of the synthesizer when it detects the operation of selecting an effector in a not-shown effect selection screen.

Next, a flowchart of processing executed by the CPU 11 of the synthesizer 10 when it detects the operation of selecting an effect on a not-shown effect selection screen is shown in FIG. 25.

This processing corresponds to the processing shown in FIG. 20, and that processing is applied to control of the effect selection screen which accepts selection of an effect by basically reading SVc, TGc, CAc, and TCc as SVe, EFe, CAe, and FXe, respectively, and the tone generator as the effector, the timbre as the effect, and the timbre data as the effect data, respectively.

However, the contents of the logic connection performed in Steps S95 and S101 are different from those in the case of FIG. 20, and therefore those points will be described.

First, in the case of Step S95 where the effector EFe in use is the effector 18 in the synthesizer 10, the CPU 11 establishes the logic connection such that the waveform data generated by the tone generator TGc of the TE server SVc is inputted into the effector EFe (the effector 18) and the output of the effector EFe is inputted into the output mixer (the mixer 17). Note that, in this event, the logic connection between the synthesizer 10 and the TE server SVc has been already established in Step S15 in FIG. 7.

To establish the logic connection in Step S95, in particular, when SVc is the TE server, for the CPU 11, it is only necessary on the TE server SVc side to instruct the TE server SVc to make setting such that the mixer 313 outputs the waveform data generated by the process of the tone generator TGc to the synthesizer 10 via the waveform transmission path, and on the synthesizer 10 side to make setting in the mixer 17 such that the mixer 17 supplies the waveform data received from the TE server SVc to the effector 18 (the effector EFe), acquires again the output of the effector 18 (the effector EFe), and outputs it to the DAC 23.

On the other hand, when SVc is the own apparatus, it is only necessary for the CPU 11 to make setting in the mixer 17 such that the mixer 17 supplies the waveform data generated by the tone generation unit 16 (the tone generator TGc) to the effector 18 (the effector EFe), acquires again the output of the effector 18 (the effector EFe), and outputs it to the DAC 23.

Note that if the effector which has been previously selected is also the internal effector, it is unnecessary to establish the logic connection again here.

In the case of Step S101 where the effector EFe in use is the external effector, the CPU 11 establishes the logic connection such that the waveform data generated by the tone generator TGc of the TE server SVc is inputted into the effector EFe of the TE server SVe and the output of the effector EFe is inputted into the output mixer (the mixer 17).

In this case, in particular, when SVc is the TE server, for the CPU 11, it is only necessary on the TE server SVc (=SVe) side to instruct the TE server SVc to make setting such that the mixer 313 supplies the waveform data generated by the process of the tone generator TGc to the process of the effector EFe and outputs the waveform data outputted from the process of the effector EFe to the synthesizer 10 via the waveform transmission path, and on the synthesizer 10 side to make setting such that the mixer 17 outputs the waveform data received from the TE server SVc to the DAC 23.

On the other hand, when SVc is the own apparatus, for the CPU 11, it is only necessary on the TE server SVe side to instruct the TE server SVe to make setting such that the mixer 313 supplies the waveform data inputted from the synthesizer 10 via the waveform transmission path to the process of the effector EFe and outputs the waveform data outputted from the effector EFe to the synthesizer 10 via the waveform transmission path, and on the synthesizer 10 side to make setting in the mixer 17 such that the mixer 17 outputs the waveform data generated by the tone generation unit 16 (the tone generator TGc) to the TE server SVe via the waveform transmission path and outputs the waveform data inputted from the TE server SVe via the waveform transmission path to the DAC 23.

Note that if the effector which has been previously selected is also the external effector, it is unnecessary to establish the logic connection again here.

Through the above processing shown in FIG. 25, when an effect is selected in the effect selection screen, the synthesizer 10 can activate the function of the effector having that effect to establish a state in which the effector can perform the selected effect processing. When an external effector needs to be used, the CPU 11 can prepare the UI (the UI control program) suitable for editing the effect parameters used by the effector.

As is clear from FIG. 13, the effect imparted to the keyboard part and the effect imparted to the A/D part can be separately selected. Though the variables relating to the selected effects are not shown separately for the keyboard part and for the A/D part in FIG. 15, the variables are actually prepared separately for each of the parts. In addition, for these parts, the logic connections for waveform data transmission are also separately constructed, and the waveform data on each of the parts is outputted after mixed by the output mixer function according to the setting contents of the mixer 17 when finally outputted from the mixer 17 to the DAC 23.

Figure 26:
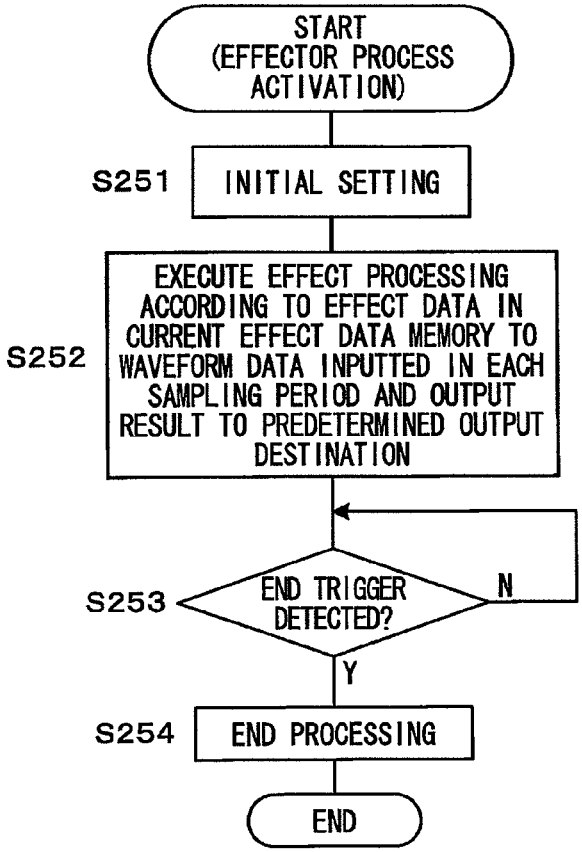
FIG. 26 is a flowchart of an effector process activated in Step S100 in FIG. 25.

A flowchart of the effector process activated in Step S100 in FIG. 25 is shown in FIG. 26. This processing corresponds to the function of the effector 314.

When the TE demon instructs activation, the CPU 31 starts execution of this processing as the background service or the system process.

After the required initial setting (S251), the CPU 31 executes the effect processing according to the effect data in the current effect data memory to the waveform data inputted in each sampling period and outputs the result to a predetermined output destination (S252). The CPU 31 repeats this processing until detecting an end trigger such as a stop instruction from the TE server, stop of the operation of the PC 30 or the like (S253). When detecting the end trigger, the CPU 31 performs processing necessary for the completion of the process such as cancel of the logic connection and the like (S254), and ends the processing.

Though the effector control process corresponding to the tone generator control process is not shown for the effector 314, the functions necessary for control of the effector 314 such as setting, editing and so on of the effect data are provided by the TE demon.

Figure 27:
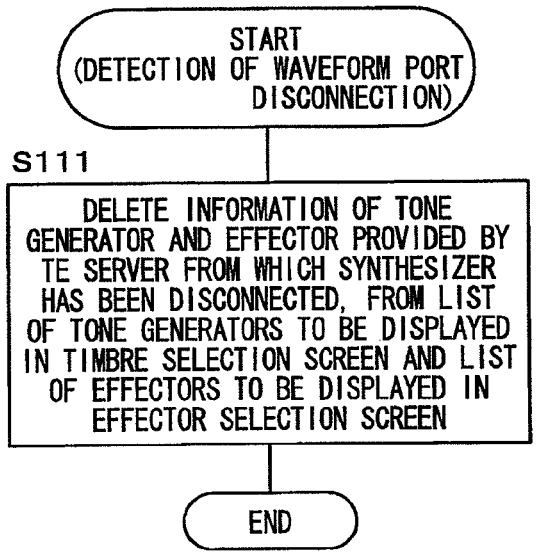
FIG. 27 is a flowchart of processing executed by the CPU of the synthesizer when it detects disconnection from the TE server.

Next, a flowchart of processing executed by the CPU 11 of the synthesizer 10 when it detects disconnection from the TE server is shown in FIG. 27.

The CPU 11 of the synthesizer 10 judges that the synthesizer 10 is disconnected from the TE server when it no longer receives the waveform data from the TE server to which the logic connection has been established. The CPU 11 then executes the processing in FIG. 27 and deletes the information on the tone generator and the effector provided by the TE server from which the synthesizer 10 has been disconnected, from the list of tone generators displayed in the timbre selection screen 430 and the list of effectors displayed in the effect selection screen (S111).

After this processing, the CPU 11 cannot select any longer the timbres of the tone generator provided by the TE server from which the synthesizer 10 has been disconnected and the effects of the effector provided by the TE server. Note that when disconnection is detected, the mixer 18 automatically mutes the input from the disconnection destination via the waveform I/O 19*b* by means of hardware.

Through the above processing, even when the logic connection to the TE server is cut off due to the physical disconnection from the PC 30, stop of the operation of the PC 30 or the like, the CPU 11 can continue the generation of the waveform data and the effect processing, similarly before the disconnection, within the abilities provided by the synthesizer 10 and the still connected TE server. If the connection to the PC 30 is restored again, the CPU 11 can establish the connection again by the processing shown in FIG. 7.

Next, the operation of editing the timbre data and the effect data performed in the synthesizer 10 will be described.

As has been described, in the synthesizer 10, the user can move to the screen for editing the contents of the timbre data stored in the current timbre data memory corresponding to the tone generator of the timbre selected in the corresponding part by pressing the timbre edit button 404 in the TE setting screen 400 shown in FIG. 13 to thereby shift to an edit mode.

Figure 28:
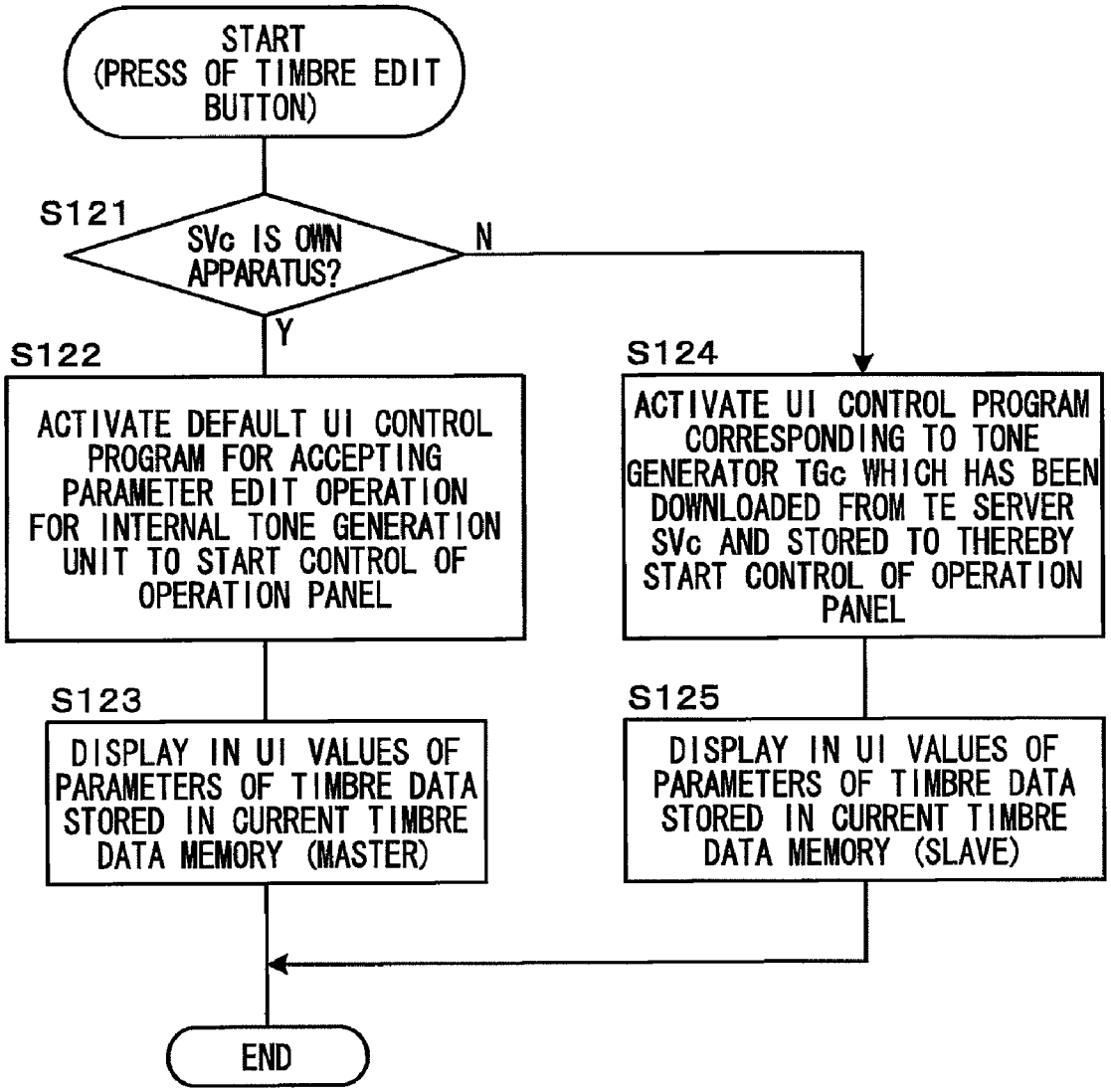
FIG. 28 is a flowchart of processing executed by the CPU of the synthesizer when it detects a press of a timbre edit button.

A flowchart of processing executed by the CPU 11 of the synthesizer 10 when it has detected a press of the timbre edit button 404 is shown in FIG. 28.

In this processing, the CPU 11 first judges whether or not SVc indicates the own apparatus, that is, whether or not the timbre of the internal tone generator has been selected (S121). When it is the own apparatus, the CPU 11 activates the default UI control program for accepting the parameter edit operation for the internal tone generation unit 16 to start control of the operation panel 15 (S122). The CPU 11 then displays in the UI the values of the parameters of the timbre data stored in the current timbre data memory and ends the processing (S123), and thereafter, the CPU 11 shifts to the parameter edit processing realized by the default UI control program.

In this case, the CPU 11 will serve as a first edit accepting device and a device that edits the timbre data stored in the current timbre data memory according to the edit operation accepted by the first edit accepting device. The functions of these devices may be those similar to the UI control function for editing the parameters of the own apparatus included in the conventional synthesizer.

On the other hand, when NO in Step S121, that is, when the timbre of an external tone generator has been selected, the CPU 11 activates the UI control program corresponding to the tone generator TGc which has been downloaded from the TE server SVc and stored, to thereby start control of the operation panel (S124). The CPU 11 then displays in the UI the values of the parameters of the timbre data stored in the current timbre data memory and ends the processing (S125). The values of the parameters displayed here are that stored in Step S74 in FIG. 20. Thereafter, the CPU 11 shifts to the parameter edit processing realized by the UI control program corresponding to the tone generator TGc.

In this case, the CPU 11 will serve as a second edit accepting device and a device which notifies the TE server of the edit contents of the timbre data according to the edit operation accepted by the second edit accepting device to thereby cause the TE server to edit the timbre data stored in the current timbre data memory corresponding to the tone generator TGc according to the notification.

The parameter edit screens (GUIs) displayed on the touch panel 151 by the UI control program in this case are, for example, as shown in FIG. 29 and FIG. 30.

These screens can be designed for easy setting operation adapted to the parameter configuration of the timbre data in the tone generator TGc, thus presenting a high operability in the edit operation of the parameters.

Figure 31:
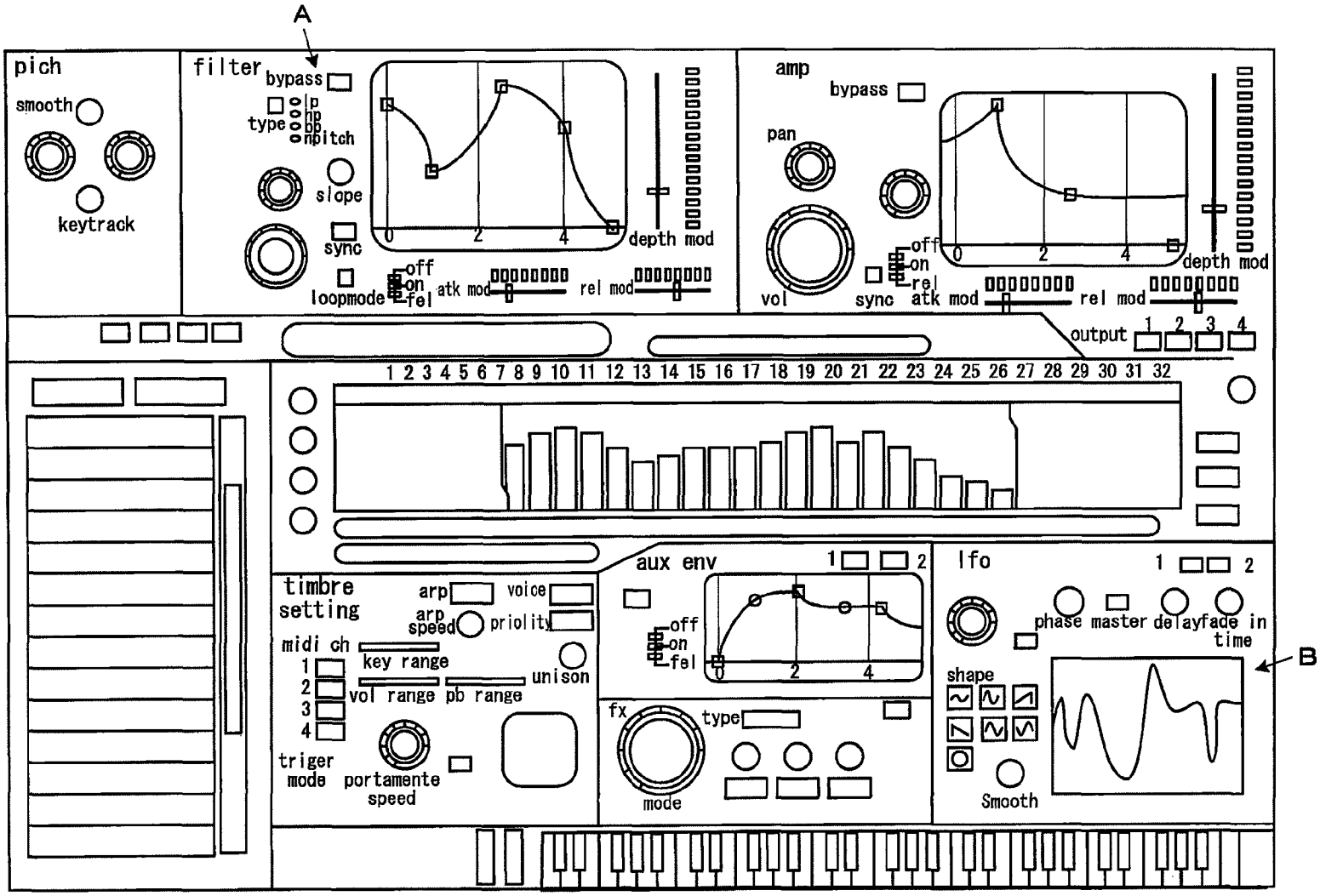
FIG. 31 is a view showing an example of a parameter edit screen used in accepting an edit operation of timbre data from the PC.

Note that since the tone generator TGc operates on the PC 30, the operation of editing the parameters can also be accepted by the PC 30. In this case, the CPU 31 executes the UI control program for PC stored in the UI control program memory 315 to display a GUI screen (for software tone generator yPhrase) as shown in FIG. 31 on the display of the PC 30 and accept the edit operation via the GUI screen. Since the display of the PC 30 is considered to be usually large in size, the GUI for accepting the setting operation relating to many parameters in one screen can be used.

Note that the software tone generator plug-in "yPhrase" is made by applying the invention to software tone generator plug-in "Xphrase (trademark)" available from Steinberg to modify, and the parameter edit functions in the GUI screen in FIG. 29 to FIG. 31 basically conform to those of Xphrase.

On the other hand, a quite large panel cannot be usually provided as the touch panel 151 of the synthesizer 10, and it is therefore difficult to use the same GUI as that displayed on the display of the PC 30. Hence, if the GUI displayed on the display of the PC 30 is divided into sections to be able to accept the edit operation of parameters for each of the sections while switching between the sections using a tub X in the screen, it is conceivable to design the UI control program downloaded by the synthesizer 10 with less work load.

Shown in FIG. 29 and FIG. 30 are examples in which such switching is possible, and the displays in FIG. 29 and FIG. 30 correspond to a filter section denoted by a symbol A and an lfo section denoted by a symbol B in FIG. 31, respectively.

Further, FIG. 32 shows the correspondence between the contents of the parameter edit operation accepted from the user and the processing executed by the CPU 11 in response to the operation.

When a touch operation to the screen of the touch panel 15 is made, the CPU 11 detects a part (knob, button, tab or the like) on the screen corresponding to the touch position and performs processing corresponding to the part.

The processing is performed by execution of the default UI control program when the CPU 11 edits the timbre data of the internal tone generation unit 16, or by execution of the UI control program downloaded from the TE server SVc when the CPU 11 edits the timbre data of the external tone generator.

Among the processing shown in FIG. 32, processing of changing the value of a parameter will be described here in more detail.

Shown in FIG. 33 is local parameter change processing by the synthesizer 10.

In this case, when the need to change the value of a parameter arises, it is only necessary to simply change the designated parameter of the timbre data stored in the current timbre data memory to the designated value (S131).

Figure 34:
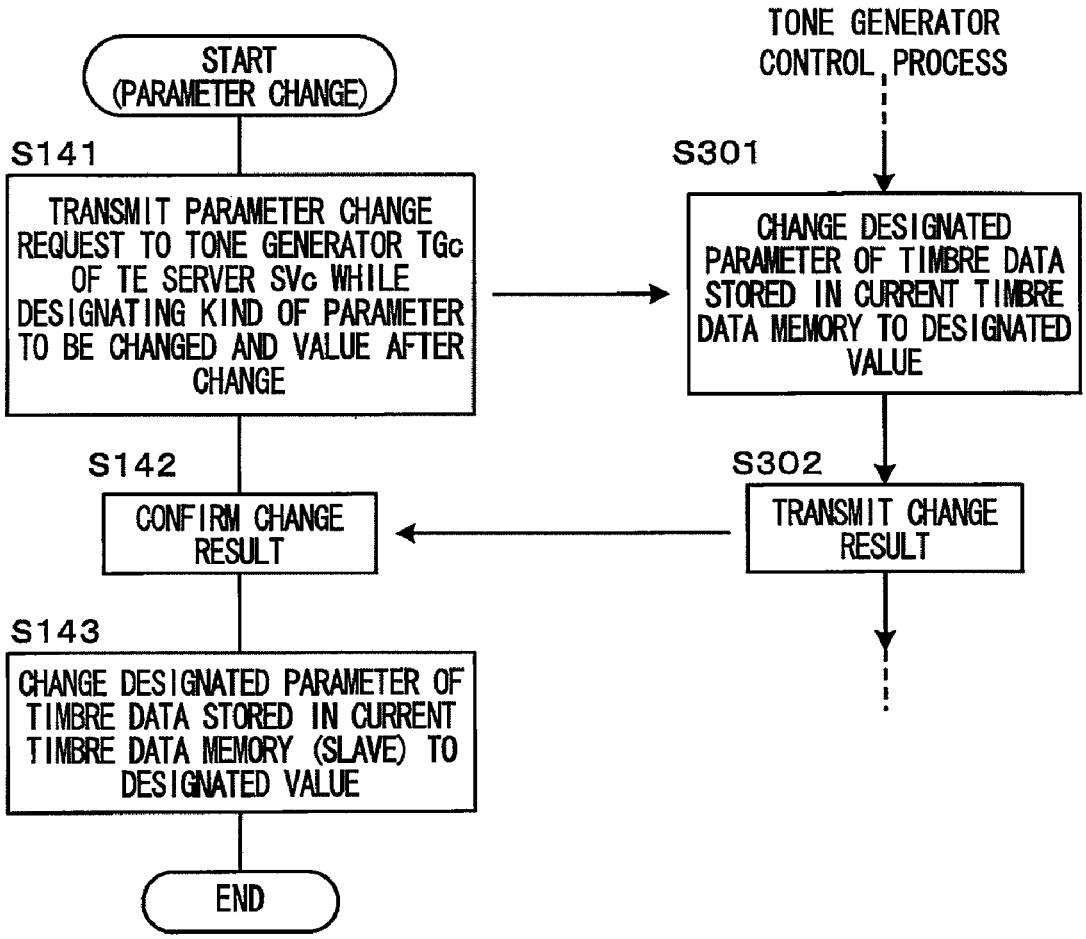
FIG. 34 is a flowchart of remote parameter change processing of changing the value of parameter stored in the current timbre data memory of the TE server by the synthesizer.

Shown in FIG. 34 is remote parameter change processing of changing the value of a parameter stored in the current timbre data memory of the TE server.

In this case, the CPU 11 first transmits a parameter change request to the tone generator TGc of the TE server SVc while designating the kind of the parameter to be changed and the value after the change (S141).

On the tone generator TGc side, the tone generator control process receives this request, reflects the change in the current timbre data memory as shown in FIG. 23 (S301), and returns the result (S302).

On the synthesizer 10 side, it is only necessary to confirm the change result (S142), and then change the value of the parameter stored in the local current timbre data memory (slave) (S143) and end the processing.

The above contents described using FIG. 28 to FIG. 34 similarly applies to the case where a press of the effect edit button 414 or 424 in the IF setting screen 400 to edit the effect data of the effect selected in the corresponding part.

Figure 35:
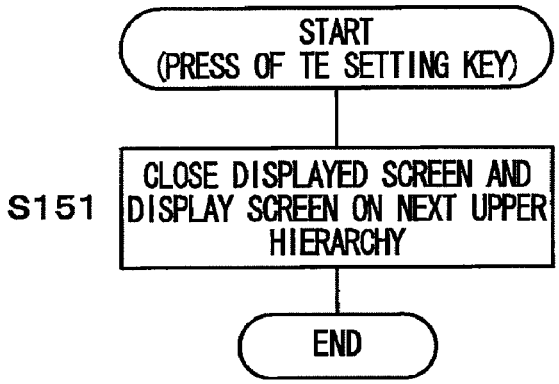
FIG. 35 is a flowchart of processing executed by the CPU of the synthesizer when it detects a press of a TE setting key.

When it is desired to get out of the edit mode, a press of the TE setting key 154 shown in FIG. 13 allows the screen to be returned to the TE setting screen 400 by the processing shown in FIG. 35.

According to the above-described synthesizer 10, when setting relating to the tone generator and effector provided by the external apparatus is made, edit using the UI control function suitable for setting object automatically becomes possible, so that expanded functions can be used with great ease. Further, only by selecting a timbre of the tone generator and an effect of the effector provided by the external apparatus, the tone generator and the effector can be automatically activated in the external apparatus for use, thus eliminating the need to operate the external apparatus to activate the program, in terms of which the expanded functions can be extremely easily used.

Here, the description of the embodiment is finished, and as a matter of course, the hardware configuration of the apparatus, the functional configuration, the data configuration, the concrete processing contents, and so on are not limited to those described in the above embodiment.

For example, though the example in which the processes realizing the functions of the TE demon and the TE server 310 operated on the PC 30 side are executed as the background service or the system process has been described in the above-described embodiment, the DAW application being an application may be made usable in such purposes.

Further, in the above-described embodiment, the UI control program for the particular kind of synthesizer 10 is stored in the UI control program memory 315. However, the size of the display (touch panel) of the synthesizer is generally different in each apparatus type. Hence, a plurality of UI control programs for displays different in size are prepared in advance to be adapted to various types of synthesizers 10, so that each synthesizer 10 may selectively request and acquire the UI control program adapted to its own display size. Alternatively, two kinds of UI control programs according to whether the display is a touch panel or not are stored in the UI control program memory 315 in advance, so that the synthesizer 10 can selectively acquire one of them.

Further, through the MIDI transmission path for real-time transmitting of the MIDI data is set separate from the transmission path for transmitting/receiving various kinds of commands in the above-described embodiment, the data form of the command may be the form which can be discriminated from that of the MIDI data so that the MIDI data is transmitted using the same transmission path as that used for transmitting the command. In this case, it becomes unnecessary to newly set the MIDI transmission path in the network 50 when the logic connection is established in Step S15 in FIG. 7.

Further, while the example in which the tone generator merely generates sound in one part has been described in the above-described embodiment, the tone generator can be also configured to generate sounds in a plurality of parts. In this case, selection of timbres and activation and stop of the tone generator associated with the selection (Steps S64, S69, S70 and so on in FIG. 20), sorting of the MIDI data by the selector 102, setting of output destination of the generated waveform data and so on are performed independently for each part. For example, even if the processing in Step S64 or S69 in FIG. 20 is executed in selecting the timbre for a first part, the tone generator used in a second part is not stopped.

Also for the effect, the effect processing for a plurality of parts can be similarly performed by independently performing various kinds of setting, activation and stop of the effector (Steps S94, S99, S100 and so on in FIG. 25) for each part.

As a matter of course, the invention is applicable to any waveform generating apparatus having a tone generator or an effect imparting apparatus such as an electronic musical instrument and so on as well as to the synthesizer. In this case, the musical operation device is not limited to a keyboard, but can be in any form such as a stringed musical instrument, wood and brass musical instrument, percussion musical instrument and so on. The musical operation device and the sound system themselves are not essential components, and the waveform generating apparatus may be apparatuses which generate the waveform data according to the performance data inputted from an external part, impart the sound effect to the waveform data inputted from an external part, or output the data to a recorder in the external part. Further, it is not always necessary to include both the tone generator and the effector, but may include only one of them.

The modifications described above are applicable in any combination within a consistent range.

As is clear from the above description, according to the waveform generating apparatus, the musical sound generating apparatus, or the sound effect imparting apparatus of the invention, the tone generation function or the sound effect imparting function can be easily expanded and the setting relating to the expanded functions can be easily made.

Accordingly, the invention can provide a highly convenient apparatuses.

What is claimed is:

1. A sound effect imparting apparatus, comprising:

a first effector that imparts a sound effect to waveform data, inputted to the sound effect imparting device, and outputs the effect imparted waveform data;

a first memory that stores an effect data defining a characteristic of the sound effect to be imparted by said first effector;

a first library that stores a plurality of effect data for said first effector;

a communication device connected to a network for communicating with a computer, connected to the network, having a second effector that imparts a sound effect to waveform data, supplied by the effect imparting device via said communication device, and outputs the effect imparted waveform data, a second memory that stores an effect data defining a characteristic of the sound effect to be imparted by said second effector, and a second library that stores a plurality of effect data for said second effector; and a selector, in response to a selection operation by a user, that, when said computer is not connected to the network, selects an effect data among the plurality of effect data stored in said first library and, when said computer is connected to the network, selects an effect data among the plurality of effect data stored in said first library and the plurality of effect data stored in said second library, wherein, when an effect data stored in the first library is selected, said selector reads out the selected effect data from said first library and stores the effect data into said first memory and, when an effect data stored in said second library is selected, said selector instructs said computer via said communication device to read out the selected effect data from said second library and store the effect data into the second memory;

a controller that, when the effect data stored in said first library is selected by said selector, controls said first effector to impart the sound effect to the waveform data according to the effect data stored in said first memory, and, when the effect data stored in said second library is selected by said selector, supplies the inputted waveform data to said computer via said communication device and instructs said computer to control said second effector to impart the sound effect to the waveform data according to the effect data stored in said second memory and to return the effect imparted waveform data to the sound effect imparting apparatus via the network; and a waveform outputting device that mixes the waveform data outputted by said first effector and the waveform data outputted by said second effector and transmitted by said computer for receipt by said communication device, and outputs the mixed waveform data.

2. A sound effect imparting apparatus according to claim 1, wherein said second effector is a process executed by said computer and when said computer is initially connected to the network, the sound effect imparting apparatus instructs said computer to activate the process of said second effector via said communication device.

3. A sound effect imparting apparatus according to claim 1, further comprising:

a downloader that, when said computer is initially connected to the network, downloads an edit program for said second effector from said computer via said communication device; and an editor, in response to an edit operation by the user, that, when the effect data stored in said first library is selected by said selector, edits said effect data stored in said first memory and, when a effect data stored in said second library is selected by said selector, instructs said computer to edit said effect data stored in said second memory according to the downloaded edit program.

4. A musical sound generating apparatus having an internal effector and a communication device connected to a network for communicating with a computer, connected to the network, capable of providing an expanded effect function, said musical sound generating apparatus comprising:

a first device that accepts selection of an effect imparted to inputted waveform data from among an effect executed by said internal effector and an effect executed by said expanded effect function, when said computer is connected to the network;

a second device that causes said computer to activate said expanded effect function, and downloads an edit operation accepting program corresponding to said expanded effect function from said computer, when the effect executed by said expanded effect function is selected by said first device; and a third device that executes the downloaded edit operation accepting program to thereby realize a function of editing data indicating the characteristic of the effect executed by said expanded effect function, said data being stored in said computer.

* * * * *